US007769335B2

(12) United States Patent
Takagi et al.

(10) Patent No.: US 7,769,335 B2
(45) Date of Patent: Aug. 3, 2010

(54) FIXING APPARATUS

(75) Inventors: Osamu Takagi, Toyko (JP); Satoshi Kinouchi, Tokyo (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 2 days.

(21) Appl. No.: 11/890,513

(22) Filed: Aug. 7, 2007

(65) Prior Publication Data

US 2007/0297838 A1 Dec. 27, 2007

Related U.S. Application Data

(63) Continuation of application No. 10/886,703, filed on Jul. 9, 2004, now Pat. No. 7,257,361.

(30) Foreign Application Priority Data

Jul. 10, 2003 (JP) ..... 2003-195244
Jul. 16, 2003 (JP) ..... 2003-197877
Dec. 15, 2003 (JP) ..... 2003-416958

(51) Int. Cl.
*G03G 15/20* (2006.01)

(52) U.S. Cl. ..... 399/330; 399/332

(58) Field of Classification Search ..... 399/328–334
See application file for complete search history.

(56) References Cited

U.S. PATENT DOCUMENTS 4,377,336 A 3/1983 Parks et al.
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,337,969 B1 1/2002 Takagi et al.
6,415,128 B1 7/2002 Takagi et al.
6,438,335 B1 8/2002 Kinouchi et al.
6,643,476 B1 11/2003 Kinouchi et al.

(Continued)

FOREIGN PATENT DOCUMENTS

JP 5-142964 A 6/1993

(Continued)

OTHER PUBLICATIONS

JPO Machine Translation of Yoshikawa et al. (JP 09-251252 A).*

(Continued)

*Primary Examiner*—Stephen D Meier
*Assistant Examiner*—Erika Villaluna
(74) *Attorney, Agent, or Firm*—Foley & Lardner LLP

(57) ABSTRACT

A fixing apparatus according to the present invention ensures a nip width larger than a certain value by a heating roller which has a thin film metal conductive layer, and a foamed rubber layer which is bonded to the end part of the metal conductive layer, formed with a gap in a center part, and not bonded to the metal conductive layer.

12 Claims, 20 Drawing Sheets

U.S. PATENT DOCUMENTS

| | | | |
|---|---|---|---|
| 6,643,491 | B2 | 11/2003 | Kinouchi et al. |
| 6,724,999 | B2 | 4/2004 | Kikuchi et al. |
| 6,725,000 | B2 | 4/2004 | Takagi et al. |
| 6,763,206 | B2 | 7/2004 | Kinouchi et al. |
| 2003/0219271 | A1 | 11/2003 | Kinouchi et al. |
| 2004/0141038 | A1 | 7/2004 | Takagi et al. |
| 2004/0173603 | A1 | 9/2004 | Kinouchi et al. |
| 2004/0175211 | A1 | 9/2004 | Sone et al. |
| 2004/0175212 | A1 | 9/2004 | Tsueda et al. |
| 2004/0179874 | A1 | 9/2004 | Kinouchi et al. |
| 2004/0184852 | A1 | 9/2004 | Takagi et al. |
| 2004/0188421 | A1 | 9/2004 | Takagi et al. |
| 2004/0188422 | A1 | 9/2004 | Wasai et al. |
| 2004/0238531 | A1 | 12/2004 | Kikuchi et al. |
| 2004/0265021 | A1 | 12/2004 | Kinouchi et al. |

FOREIGN PATENT DOCUMENTS

| | | | | |
|---|---|---|---|---|
| JP | 05-241467 | A | | 9/1993 |
| JP | 06102790 | A | * | 4/1994 |
| JP | 7-219374 | A | | 8/1995 |
| JP | 7-306606 | A | | 11/1995 |
| JP | 8-76620 | A | | 3/1996 |
| JP | 8-129313 | A | | 5/1996 |
| JP | 09-251252 | A | | 9/1997 |
| JP | 11-184291 | A | | 7/1999 |
| JP | 2001-5315 | A | | 1/2001 |
| JP | 2002-49261 | A | | 2/2002 |
| JP | 2002-116646 | A | | 4/2002 |
| JP | 2002-250337 | A | | 9/2002 |
| JP | 2002-295452 | A | | 10/2002 |
| JP | 2002-367766 | A | | 12/2002 |

OTHER PUBLICATIONS

U.S. Appl. No. 10/799,770, filed Mar. 15, 2004, Kikuchi et al.
U.S. Appl. No. 10/805,305, filed Mar. 22, 2004, Sone et al.
U.S. Appl. No. 10/805,308, filed Mar. 22, 2004, Tsueda et al.
U.S. Appl. No. 10/805,420, filed Mar. 22, 2004, Sone et al.
U.S. Appl. No. 10/805,507, filed Mar. 22, 2004, Kikuchi et al.
U.S. Appl. No. 10/805,514, filed Mar. 22, 2004, Kinouchi et al.
U.S. Appl. No. 10/805,522, filed Mar. 22, 2004, Kikuchi et al.
U.S. Appl. No. 10/820,138, filed Apr. 8, 2004, Sone et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/945,395, filed Sep. 21, 2004, Kinouchi et al.

* cited by examiner

FIXING APPARATUS

CROSS-REFERENCE TO RELATED APPLICATIONS

The present application is a continuation based upon U.S. application Ser. No. 10/886,703, filed Jul. 9, 2004, which claims the benefit of priority from prior Japanese Patent Applications No. 2003-195244, filed Jul. 10, 2003; No. 2003-197877, filed Jul. 16, 2003; and No. 2003-416958, filed Dec. 15, 2003; the entire contents of all of which are incorporated herein by reference.

BACKGROUND OF THE INVENTION

1. Field of the Invention

The present invention relates to a fixing apparatus, which is provided in an image forming apparatus such as a copier and a printer, and fixes a developer image on a paper sheet.

2. Description of the Related Art

An image forming apparatus such as an electric copier using digital technology has a fixing apparatus for fixing a heated and fused developer image to a paper sheet by applying a pressure.

A fixing apparatus has a heating member which fuses a developer such as toner, and a pressing member which supplies a predetermined pressure to the heating member. A predetermined contact width (nip width) is formed in the contacting area (nip) between the heating member and the pressing member. A developer image fused by the heat from the heating member is fixed to a paper sheet passing through the nip by the pressure from the pressing member.

In a method using a halogen lamp as a heat source of a heating member of a fixing apparatus, a pair of rollers is provided to be capable of supplying a predetermined pressure to a member to be fixed and toner, and a halogen lamp is provided in at least one of the rollers. This configuration has been widely used.

Contrarily, in a method using induction heating, it is well known that a heat-resistant film material is formed like an endless belt or cylindrical (roller), and brought it into contact with a material to be fixed.

There is another example (Jpn. Pat. Appln. KOKAI Publication No. 2002-49261). Silicon rubber or foamed silicon rubber is used as a low-heat conductive material in a fixing apparatus, which uses a fixing roller comprising a cylindrical rigid body, a layer made of a low-heat conductive material and provided outside the rigid body, and a conductive body layer and a mold release layer provided outside the low-heat conductive material layer, and having an induction heating source for heating the conductive body layer placed opposite to the outside of the mold release layer.

In this fixing apparatus, a conductive body layer with small heat capacity is provided outside a layer made of a low-heat conductive material, and quick heating is possible by using a roller body. However, the layer made of a low-heat conductive material is a silicon rubber or foamed silicon rubber layer with a foaming rate of 250%, and when it is used in a color fixing apparatus requiring a thick toner layer, a character image may be collapsed.

In an image heating unit in which a thin conductive layer, an insulation layer and a support layer are stacked closely contacted from the front surface toward the inside and heated externally by excitation, there is an example in which one of the surface of the insulation layer contacting the thin conductive layer and the surface of the thin conductive layer contacting the insulation layer, or the both are made rough (Jpn. Pat. Appln. KOKAI Publication No. 2001-5315). In this image heating unit, the curling direction of a paper sheet ejected at the exit of nip is the toner side on a recording material. This may cause winding of the recording material around the heating roller, or hot offset.

There is another example of a heating unit (Jpn. Pat. Appln. KOKAI Publication No. 8-76620). Conductive particles or whiskers with high magnetic permeability are scattered in an elastic layer or a front layer of conductive heating material, and these layers are functioned as an elastic layer or a conductive heating layer. In this heating unit, an adhesive is deteriorated and a surface is wrinkled, or a conductive body layer may be peeled off, because a conductive layer is formed by bonding with an adhesive.

There is still another example of a heating unit (Jpn. Pat. Appln. KOKAI Publication No. 8-129313). A heating rotary body including an elastic body layer and having a metal sleeve of 10-150 μm thick outside the elastic body layer is heated externally by a heating member. In this heating unit, quick heating is possible, but the conduction of heat to a support part contacting a core metal and a support part at both ends is large, and a temperature at the ends of a roller is increased when a small size paper sheet is passed.

In recent years, to decrease power consumption, quick heating is enabled by using a heating member with a thin conductive layer of small heat capacity provided outside a layer made of a low-heat conductive material. A foamed material with a small hardness is used for a low-heat conductive material, and the hardness becomes difference from a conductive body layer made of a thin film of metal or the like. Because of the hardness difference, the foamed material used as a low-heat conductive material may be consumed or the foam may be broken, when a pressure is applied from a pressing member or when a stress such as thermal expansion and thermal shrinkage is applied. If a broken foam is increased and cavities of different size are formed, the outside diameter of a conductive layer is not kept constant in the length direction of a heating roller.

In case where a conductive layer and foamed material are bonded by applying a heat-resistant adhesive to all over the contacting surface, a foamed rubber layer which receives the heat directly from a metal layer may be expanded suddenly by the heat. Further, a metal layer may restrict thermal expansion of a foamed rubber layer by the heated metal layer, or thermal shrinkage of a foamed rubber layer on heat radiation caused by reduction of the volume of air included in the foamed rubber layer.

Thus, a foamed rubber layer is expanded toward a metal layer by thermal shrinkage, and brake of a foamed rubber layer advances further, and the life (service life) is shortened. Further, as thermal expansion or shrinkage of a foamed rubber layer occurs, a metal layer is deformed, a required nip width is not ensured at a position where a heating member contacts a pressing member, and a good fixed image cannot not be obtained.

If a metal layer and a foamed rubber layer are not bonded with an adhesive, or a metal layer is provided as a sleeve (belt), a metal layer may meander, shift from a foamed rubber layer and break as a heating roller rotates, reducing the life of a metal layer. Moreover, a complicated mechanism is required to support a belt-like metal layer. When a metal belt is driven by the pressure from a pressing mechanism, the belt may be slipped by oil roller or the like, and may not be rotated.

BRIEF SUMMARY OF THE INVENTION

According to an aspect of the present invention, there is provided a fixing apparatus comprising:

a roller member which includes a hollow cylindrical metal member, and a support member provided inside the metal member, wherein the support member includes a first cross section having a first outside diameter, and a second cross section having a second outside diameter smaller than the first outside diameter, and the first cross section of the support member contacts the inside of the metal member, and the second cross section of the support member has a gap in the space to the metal member.

According to another aspect of the present invention, there is provided a fixing apparatus comprising:

a roller member, a core member extending in the axial direction;

a support member located outside the core member, and a metal member located outside the support member and formed as a hollow cylinder, wherein a center part in the axial direction has a first hardness, and both end parts holding the center part have a second hardness smaller than the first hardness.

According to further another aspect of the present invention, there is provided a fixing apparatus comprising:

a roller member;

a core member extending in the axial directional;

a support member located outside the core member;

a metal member located outside the support member and formed as a hollow cylinder, and;

an air vent to guide the air included in the support member to the outside.

According to another aspect of the present invention, there is provided a fixing apparatus comprising:

a rotary member which includes a core member including a rotary axis, and a metal conductive layer connected to the core member;

a heating unit which heats the metal conductive layer; and a pressing unit which supplies a pressure to the rotary member.

According to further another aspect of the present invention, there is provided a fixing apparatus comprising:

a member to be heated which is elastic material with heat insulation constructed in one body with a conductive layer, and is formed cylindrical concentric with a rotary axis or like an endless belt in which an optional position is moved by a rotary axis, the conductive layer is maintained at a predetermined temperature;

a pressing member which supplies a predetermined pressure to the member to be heated; and a heating unit which heats the member to be heated, wherein the rotary axis penetrates the member to be heated.

According to another aspect of the present invention, there is provided a fixing apparatus comprising:

a member to be heated which has heat insulation, formed cylindrical, and constructed in one body with a conductive layer maintained at a predetermined temperature, in the circumference;

a pressing member which supplies a predetermined pressure to the member to be heated;

a heating unit which heats the member to be heated; and a support member which is provided at both end parts of the member to be heated in the length direction, and supports the member to be heated rotatable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, embodiments of the present invention will be explained in detail with reference to the accompanied drawings.

Figure 1:
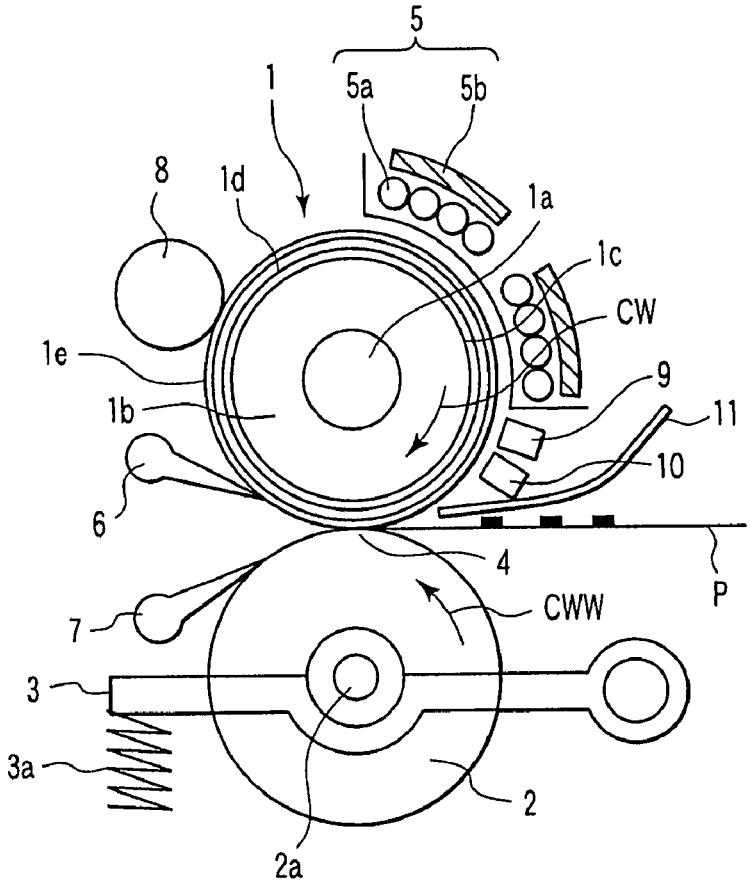
FIG. 1 is a schematic diagram showing an example of a fixing apparatus according to the present invention.

FIG. 1 shows an example of a fixing apparatus of the present invention.

As shown in FIG. 1, a fixing apparatus has a heating member (a heating roller) 1 which contacts the surface of material to be transferred, or a paper sheet P adhered with a toner T, and heats the toner T and paper sheet P, and a pressing member (a pressing roller) 2 which applies a predetermined pressure to the heating roller 1.

The heating roller 1 has a core rod 1*a* or an axis made of material with a rigidity (hardness) not deformed by a predetermine pressure, an elastic layer (foamed rubber layer, sponge layer, silicon rubber layer) 1*b*, and a metal member (metal conductive layer) 1*c*. In this embodiment, it is preferable that a solid rubber layer 1*d* composed of a thin film layer such as a heat-resistant silicon rubber, for example, and a mold release layer 1*e* are provided further outside the metal conductive layer 1*c*.

Te pressing roller 2 is preferably provided with a center axis 2*a*. The center axis 2*a* receives a predetermined pressure from a pressing mechanism 3, which is pressed by a pressing spring 3*a*. Thus, the pressing roller 2 is press contacted to the heating roller 1, and a certain width (nip width) is formed in the contact part (nip) of both rollers in the direction of conveying a paper sheet P. The pressing roller 2 is not limited to this type, but may be a roller having a metal conductive layer and an elastic layer like the heating roller 1.

The heating roller 1 contacting the pressing roller 2 with a certain nip width taken therebetween, is rotated in the arrow direction (clockwise) by a driving motor (not shown). As the heating roller 1 is rotated, the pressing roller 2 is rotated in the arrow direction (counterclockwise).

An exciting coil 5*a* which supplies a predetermined magnetic field to the metal conductive layer 1*c* of the heating roller 1, and a heating mechanism 5 including a magnetic body core 5*b* located outside the exciting coil are arranged outside the heating roller 1. The number of turns of electric wire of the exciting coil 5*a* can be reduced by providing a magnetic core 5*b*.

In this embodiment, the induction heating method is used for the heating mechanism 5, but a method of heating the metal conductive layer 1*c* by a radiation heat is also permitted.

When a high frequency current is supplied from a not-shown exciting circuit (inverter circuit), the exciting coil 5*a* generates a predetermined magnetic field. By the supply of this magnetic field, an eddy current flows in the metal conductive layer 1*c*, and Joule heat is generated corresponding to the resistance of the metal conductive layer 1*c*, and the heating roller 1 is heated by the Joule heat.

Toner T is fused by the heat from the heating roller 1, and fixed to a paper sheet P when a paper sheet P adhered with the toner T passes through a contacting position (a nip) between the heating roller 1 and pressing roller 2, and receives a predetermined pressure from the pressing roller 2.

In the circumference of the heating roller 1, a separation blade 6 for separating the paper sheet P from the heating roller 1, a separation blade 7 for separating the paper sheet P from the pressing roller 2, and a cleaning roller 8 for eliminating the toner adhered to the heating roller 1 are arranged sequentially in the rotating direction from the nip between the heating roller 1 and pressing roller 2. At a predetermined position in the length direction of the heating roller 1, a thermistor 9 for detecting the temperature around the circumference of the heating roller 1, and a thermostat 10 for detecting increase of the surface temperature of the heating roller 1 up to an abnormal value and interrupting the power supplied to the exciting coil 5*a* are arranged. In the upstream of the nip part 4 formed by the heating roller 1 and pressing roller 2, a guide plate 11 for guiding the front end of paper sheet P to the nip part 4 is provided.

It is permitted to provide a plurality of thermistor 9 and thermostat 10. If a paper sheet P is difficult to separate, the separation blades 6 and 7 can be provided two or more. Contrarily, if a paper sheet P is easily separated, the blades can be omitted.

In this embodiment, the exciting coil 5*a* is formed by winding a wire around an imaginary axis, and has the length longer than at least paper passing area (area contacting the paper sheet P) in the length direction of the heating roller 1. The exciting coil 5*a* having this form can generate a magnetic flux collectively, and can heat locally the metal conductive layer 1*c* of the heating roller 1.

As a wire of the exciting coil 5*a*, a litz wire made by binding a plurality of surface insulated wires Is used. By using a litz wire as a wire of the exciting coil 5*a*, it is possible to make the wire diameter smaller than the penetration depth. Thus, the exciting coil 5*a* can generated effectively a magnetic field even when an AC current is supplied. In this embodiment, a litz wire made by binding 16 copper wires of 0.5 mm in diameter with the surface insulated by heat-resistant polyamide is used.

A high frequency current of 20-50 kHz is supplied to the exciting coil 5*a*, as an inverter circuit driving frequency. Thus, a calorific power outputted from the heating roller 1 can be varied in a range of 300-1500 W.

Embodiment 1

An example of the heating roller 1 will be explained in detail by referring to FIGS. 2 and 3.

Figure 2:
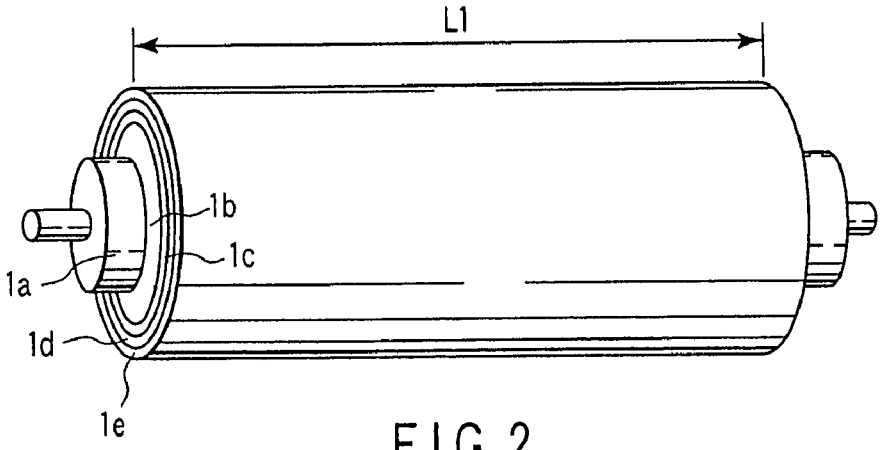
FIG. 2 is a drawing explaining an example of a roller applicable to the fixing apparatus shown in FIG. 1.

FIG. 2 is a perspective view of the heating roller 1.

As described above, the heating roller 1 has a core rod 1*a*, a foamed rubber layer 1*b*, a metal conductive layer 1*c*, a solid rubber layer 1*d*, and a mold release layer 1*e*.

The foamed rubber layer 1*b* is preferably 5-10 mm thick, and the metal conductive layer 1*c* is 5-100 μm, and the solid rubber layer 1*d* is 100-200 μm, respectively. In this embodiment, the foamed rubber layer 1*b* is 5 mm, the metal conductive layer 1*c* is 40 μm, the solid rubber layer 1*d* is 200 μm, and the mold release layer 1*e* is 30 μm, respectively. The heating roller 1 is 40 mm in diameter.

The metal conductive layer 1*c* is made of conductive material (e.g., nickel, stainless steel, aluminum, copper, or aluminum-stainless steel composite material). The length L1 of the heating roller 1 in the longitudinal direction is preferably 330 mm. Moreover, the metal conductive layer 1*c* can be made of a blend of heat-resistant resin and metal powder (e.g., powder of gold, platinum, silver, copper, aluminum, iron, nickel, stainless steel, and aluminum-stainless steel composite material).

Figure 3:
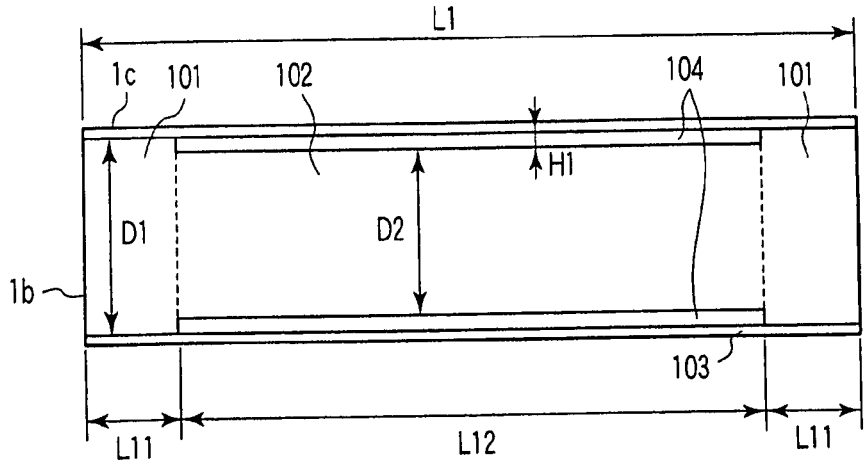
FIG. 3 is a diagram explaining an example of the roller applicable to the fixing apparatus shown in FIG. 1.

FIG. 3 is a cross section in the axial direction of the heating roller 1 of the foamed rubber layer 1*b* and metal conductive layer 1*c*.

The foamed rubber layer 1*b* includes an end part 101 which has the outside diameter D1 and is located at both ends of the axial direction, and a center part 102 which has the outer diameter D2 and is located in the space to the end part 101. The outer diameter D2 is shorter than the outer diameter D1. In this embodiment, the outside diameters D1 and D2 are preferably 39.7 mm and 39.3 mm.

(1) For example, the end part 101 has the length L11 in the axial direction, including the paper non-passing area of the heating roller 1. The paper non-passing area is defined as an area not to pass the paper sheet P conveyed between the heating roller 1 and pressing roller 2. The length L11 is preferably 15 mm.

The center part 102 has the length L12 in the axial direction, including the paper passing area of the heating roller 1. The paper passing area is defined as an area to contact the paper sheet P with the heating roller 1 while being conveyed between the heating roller 1 and pressing roller 2. Namely, the paper passing area is required to have the hardness to ensure the nip width larger than a certain value to obtain a high quality image by the pressure from the pressing roller 2.

The length L12 is preferably 300 mm, for example, as the length a little longer than the shorter side of A3 size paper sheet. As the outer diameter D2 of the center part 102 is shorter than the outside diameter D1 of the end part 101, that is, the circumference of the center part 102 is lower than the circumference of the end part 101, a step 103 is formed in the circumference of the foamed rubber layer 1*b*.

The metal conductive layer 1*c* is provided outside the foamed rubber layer 1*b*, and is a cylindrical endless member having certain internal and external diameters in the axial direction. The metal conductive layer 1*c* is bonded only to the end part 101 of the foamed rubber layer 1*b* provided inside by a heat-resistant adhesive, for example. In this embodiment, thickness of adhesive is 30 μm.

At the end part 101, the non-bonded area of the metal conductive layer 1*c* is maintained at the same outer diameter as that of metal conductive layer 1*c* bonded to the end part 101, by being held by a predetermined tension. It is of course that the solid rubber layer 1*d* and mold release layer 1*e* provided outside the metal conductive layer 1*c* are maintained at certain outside diameters.

A gap 104 is formed between the center part 102 of the foamed rubber layer 1*b* and metal conductive layer 1*c*. The gap 104 has the height H1 in the radial direction of the heating roller 1. In this embodiment, the height H1 is 200 μm.

There, the center part has smaller hardness than the hardness of the end part in the heating roller 1. In this embodiment, the hardness of the center part is E64, the hardness of the end part is E65, respectively, in the measurement with an E-type durometer made by ASKER.

That is to say the heating roller 1 has the foamed rubber layer including a different outer diameter of the center part and end part, in other words, the outer diameter of the center part of the foamed rubber layer is shorter than the outer diameter of end part of the foamed rubber layer by 400 μm.

At this time, the hardness of the center part of the heating roller 1 is smaller than the hardness of end part of the heating roller 1 by at least E1. With reference to the relation between hardness and differ of outer diameter, showing in FIG. 21 as Y2.

Therefore, the center part 102 not bonded to the metal conductive layer 1*c* can reduce the influence of thermal expansion and shrinkage caused by the heat from the metal conductive layer 1*c*. Namely, thermal expansion occurs, consumption and break of the foamed rubber layer 1*b* caused by being limited by the metal conductive layer 1*c* can be decreased, and the hardness to ensure the nip width larger than a certain value can be held to obtain a high quality image. When thermal shrinkage occurs, consumption and break of the foamed rubber layer 1*b* caused by expansion toward the metal conductive layer 1*c* at a location with concentrated stress, and the problem of unstable nip width due to deformation of the metal conductive layer 1*c* can be improved.

As to the center part 102 not bonded to the metal conductive layer 1*c*, compared with the bonded state, the stress received directly from the metal conductive layer 1*c* rotated while receiving the pressure from the pressing roller 2 (hereinafter, described as a stress by adhesion) is decreased, and consumption and break of the foamed rubber layer 1*b* are decreased and a long like is maintained.

(2) The length L11 of the end part 101 is not limited to the range of paper non-passing area, but may include a part of the paper passing area in addition to the paper non-passing area, as long as it is the area where a defect does not occur when forming an image. Namely, the length L11 may be longer than the length set as a paper non-passing area, and be the length expanded toward the paper passing area.

(3) The length L11 of the end part 101 may be determined in the range that sufficient bonding strength is ensured between the foamed rubber layer 1*b* and metal conductive layer 1*c*. Namely, the range ensuring sufficient bonding strength is the range that the metal conductive layer 1*c* is not separated from the end par 101 of the foamed rubber layer 1*b*, even if the pressure from the pressing roller 2 and the stress by the turning force from a not-shown driving circuit are supplied, and the length L11 is preferably 3-15 mm.

As the length L11 of the end part 101 is changed as explained above, the boundary between the end part 101 and center part 102, or the step 103 is also moved. Thus, it is preferable that the length L11 is changed, so that the step 103 is formed at a position to ensure a nip width in the range that a defect does not occur in an image.

Further, as the hardness of the foamed rubber layer 1*b* is small, even the foamed rubber layer 1*b* having the outside diameter larger than the inside diameter of the metal conductive layer 1*c* can be contained in the metal conductive layer 1*c*.

Embodiment 2

Next, detailed explanation will be given on a different example of the heating roller 1 with reference to FIG. 4.

As described above, the heating roller 1 has a core rod 1*a*, a metal conductive layer 1*c*, a solid rubber layer 1*d*, and a mold release layer 1*e*. A foamed rubber layer 200*b* is provided outside the core rod 1*a* and inside the metal conductive layer 1*c*.

Figure 4:
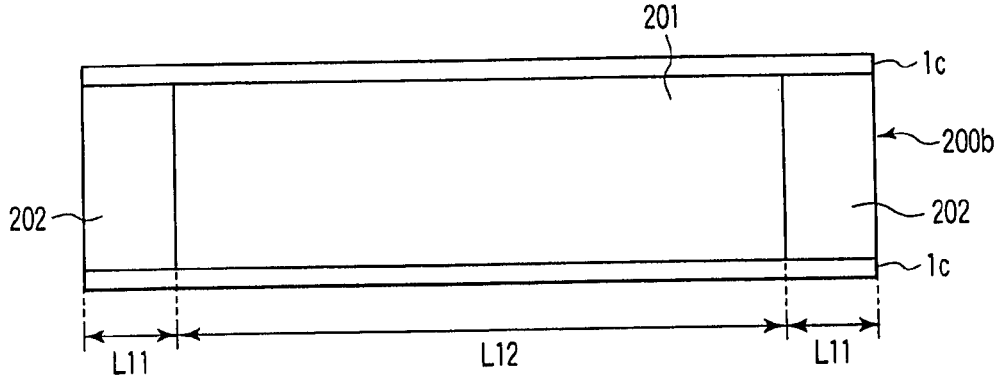
FIG. 4 is a diagram explaining another example of the roller applicable to the fixing apparatus shown in FIG. 1.

FIG. 4 is a cross section of the foamed rubber layer 200*b* and metal conductive layer 1*c* in the axial direction of the heating roller 1.

The foamed rubber layer 200*b* includes a center part 201 having a first hardness, and an end part 202 which is located at both ends of the center part 201 and has a second hardness larger than the first hardness. In this embodiment, the first and second hardness are E28 and E35, respectively, in the measurement with an E-type durometer.

The first hardness is determined in a range that the nip width larger than a certain value is ensured, to obtain a high quality image. As the hardness is small or soft, the nip width increases.

The second hardness is determined in a range that sufficient strength is ensured between the foamed rubber layer 200*b* and metal conductive layer 1*c*. As the hardness is large or hard, the stress by adhesion is reduced. As the foamed rubber layer 200*b* is less deformed (including a broken foam), the metal conductive layer 1*c* is hard to peel off.

The foamed rubber layer 200*b* consists of independent center part 201 and end part 202. The center part 201 and end part 202 are bonded with a heat-resistant adhesive in the boundary surface, and formed as one body. Thus, the foamed rubber layer 200*b* with a different hardness in a different area can be easily formed.

The end part 202 has the length L11 in the axial direction of the heating roller 1. The center part 201 has the length L12 in the axial direction of the heating roller 1. The length L11 of the end part 202 may by the length including the area defined as a paper non-passing area (1), as in the first embodiment, or may be determined in the range including a part of the paper passing area in addition to the paper non-passing area where an image forming defect does not occur (2), or in the range that sufficient bonding strength is ensured (3).

The metal conductive layer 1*c* is bonded to the whole surface or part of the foamed rubber layer 200*b* provided inside, in the circumference of the foamed rubber layer 200*b*, by using a heat-resistant adhesive, for example. The metal conductive layer 1*c* is preferably bonded only to the end part 202 of the foamed rubber layer 200*b* provided inside.

Therefore, the center part 201 maintains the nip width larger than the required certain value, and a high quality image can be obtained. Further, the stress by adhesion is reduced by the center part 201 not bonded to the metal conductive layer 1*c*, and consumption and break of the foamed rubber layer 1*b* can be decreased and a long life can be held. Moreover, the end part 202 having the second hardness ensuring sufficient bonding strength prevents the metal conductive layer 1*c* from separating from a predetermined position bonded with the heating roller 1 and breaking.

Embodiment 3

Next, detailed explanation will be given on another example of the heating roller 1 with reference to FIG. 5.

As described above, the heating roller 1 has a core rod 1*a*, a metal conductive layer 1*c*, a solid rubber layer 1*d*, and a mold release layer 1*e*. A foamed rubber layer 300*b* is provided outside the core rod 1*a* and inside the metal conductive layer 1*c*.

Figure 5:
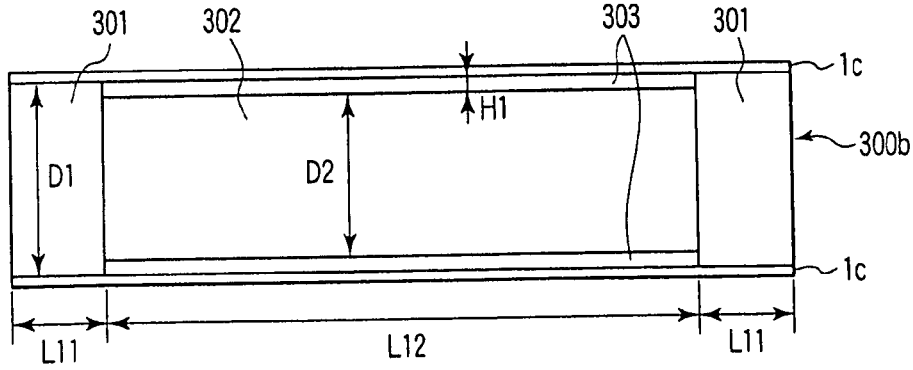
FIG. 5 is a diagram explaining still another example of the roller applicable to the fixing apparatus shown in FIG. 1.

FIG. 5 is a cross section of the foamed rubber layer 300*b* and metal conductive layer 1*c* in the axial direction of the heating roller 1.

The foamed rubber layer 300*b* includes an end part 301 which is located at both ends in the axial direction and has an outside diameter D1, and a center part 302 which is located between the end part 301 and has an outside diameter D2. The outside diameter D2 is longer than the outside diameter D1. The outside diameters D1 and D2 are preferably 39.7 mm and 39.3 mm, as in the first embodiment. Like the foamed rubber layer 200*b*, the foamed rubber layer 300*b* consists of independent end part 301 and center part 302. These parts are bonded with a heat-resistant adhesive in the boundary surface, and formed as one body.

The end part 301 has the length L11 determined in the above-mentioned predetermined range. The center part 302 has the length L12 determined in the above-mentioned predetermined range.

Like the second embodiment, the center part 302 has a first hardness, and the end part 301 has a second hardness larger than the first hardness.

The metal conductive layer 1*c* is bonded only to the end part 301 of the foamed rubber layer 300*b* provided inside, by using a heat-resistant adhesive, for example.

A gap 303 is formed between the center part 302 and metal conductive layer 1*c*. The gap 303 has the height H1 in the radial direction of the heating roller 1. The height H1 is preferably 200 μm.

Therefore, the center part 302 not bonded to the metal conductive layer 1*c* can decrease consumption and break of the foamed rubber layer 1*b* caused by thermal expansion and shrinkage, and improve the nip width fluctuation problem caused by deformation of the metal conductive layer 1*c*.

The center part 302 maintains the nip width larger than the required certain value, and a high quality image can be obtained. Further, the stress by adhesion is reduced by the center part 302 not bonded to the metal conductive layer 1*c*, and consumption and break of the foamed rubber layer 1*b* can be decreased and a long life can be held. Moreover, the end part 301 having the second hardness ensuring sufficient bonding strength prevents the metal conductive layer 1*c* from separating from a predetermined position bonded with the heating roller 1 and breaking.

Figure 6:
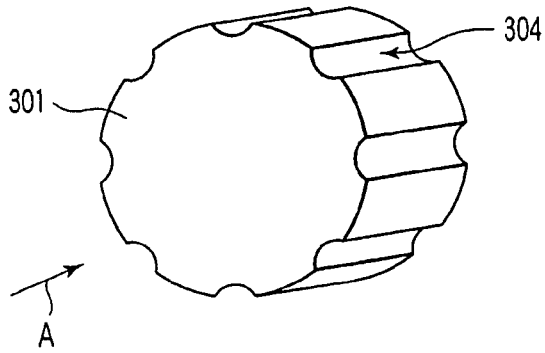
FIG. 6 is a drawing explaining an example of an end part of the foamed rubber layer shown in FIG. 5.

In the circumference of the end part 301, there is formed a plurality of air vents 304 or grooves with a cavity of predetermined length (e.g., the distance L11 in the axial direction of the end part 301) in the axial direction of the heating roller 1, as shown in FIG. 6. The air vent 304 is formed semicircular sinking toward the axis of the rotating roller, for example, in the circumference of the end part 301, viewed from the arrow A direction in the drawing.

The metal conductive layer 1*c* is bonded to the area of the end part 301 where the air vent 304 is not formed, by using a heat-resistant adhesive, for example.

Bubbles formed in the foamed rubber layer 300*b* store the heat supplied from the metal conductive layer 1*c*, and the heat is used more efficiently. However, the above-mentioned problem may occur in the circumferences that thermal expansion and shrinkage of the foamed rubber layer 300*b* are restricted by the adhesion to the metal conductive layer 1*c*.

The air vent 304 guides the heat existing in the area where the metal conductive layer 1*c* faces the foamed rubber layer 300*b*, or in the gap 303, to the outside of the gap 303. This decreases consumption and break of the foamed rubber layer 1*b* caused by thermal expansion and shrinkage of the foamed rubber layer 300*b*, and solves the nip width fluctuation problem caused by deformation of the metal conductive layer 1*c*.

Figure 7:
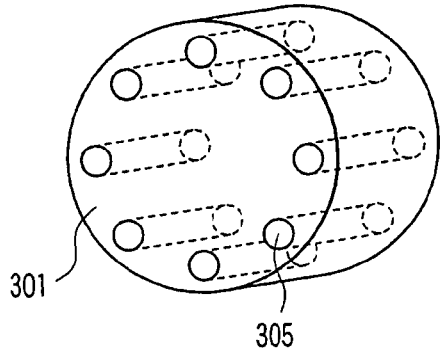
FIG. 7 is a drawing explaining another example of the end part of the foamed rubber layer shown in FIG. 5.

Further, as shown in FIG. 7, a plurality of air vents 305 having a predetermined length in the axial direction of the heating roller 1 is formed in the end part 301. Like the above-mentioned air vent 304, this air vent 305 guides the heat existing in the gap 303 to the outside of the gap 303.

The end part 301 in which the air vent 305 is formed is maintained circular having a certain outside diameter, and an adhesive can be applied all over the circumference. This decreases the labor in the manufacturing process, and increases the bonding strength.

Of course, the heat value required for fixing is ensured by adjusting the discharged heat volume by controlling the sizes of the gaps 304 and 305.

Though not shown, the air vent 305 having a predetermined length (e.g., the distance L12 in the axial direction of the center part 302) in the axial direction of the heating roller 1 may be formed in the center part 302 of the foamed rubber layer 300*b*, and may be connected to the air vent 305 formed in the end part 301.

Embodiment 4

Next, detailed explanation will be given on still another example of the heating roller 1 with reference to FIG. 8.

As described above, the heating roller 1 has a core rod 1*a*, a solid rubber layer 1*d*, and a mold release layer 1*e*. A foamed rubber layer 400*b* and metal conductive layer 400*c* are provided outside the core rod 1*a*.

Figure 8:
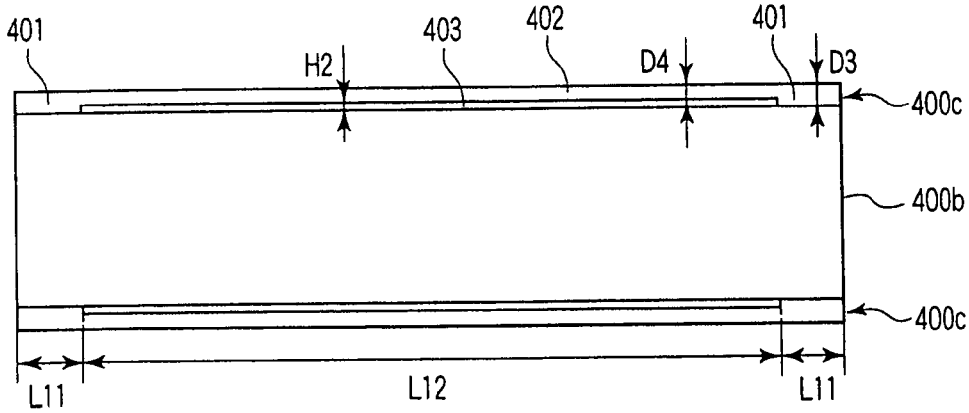
FIG. 8 is a diagram explaining still another example of the roller applicable to the fixing apparatus shown in FIG. 1.

FIG. 8 is a cross section of the foamed rubber layer 400*b* and metal conductive layer 400*c* in the axial direction of the heating roller 1.

The foamed rubber layer 400*b* has a certain outside diameter in the axial direction of the heating roller 1.

The metal conductive layer 400*c* is a cylindrical endless member having a certain outside diameter in the axial direction of the heating roller 1. The metal conductive layer 400*c* includes an end part 401 which is located at both ends in the axial direction and has the thickness D3, and a center part 402 which is located between the end part 401 and has the thickness D4.

The thickness D3 is thicker (longer) than the thickness D4. In this embodiment, the thickness D3 is 100 μm, and the thickness D4 is 40 μm.

The end part 401 has the length L11 determined in the above-mentioned predetermined range, and the center part 402 has the length L12 determined in the above-mentioned predetermined range.

The foamed rubber layer 400*b* is bonded to the end part 401 of the metal conductive layer 400*c* provided outside, by using a heat-resistant adhesive, for example. By being held by a predetermined tension at the end part 401, the center part 402 not bonded to the metal conductive layer 400*c* is maintained at the same outside diameter as the end part 401. Of course, the solid rubber layer 1*d* and mold release layer 1*e* provided outside the metal conductive layer 1*c* are maintained at certain outside diameters.

Therefore, a gap 403 is formed between the foamed rubber layer 400*b* and the center part 402 of the metal conductive layer 400*c*. The gap 403 has the height H2 in the radial direction of the heating roller 1. The height H2 is preferably maintained at 60 μm by being supported by the end part 401.

Thus, as the thickness of the metal conductive layer is thick at the end part 401 bonded to the foamed rubber layer 400*b*, the bonding strength of the foamed rubber layer 400*b* to the metal conductive layer 400*c* is increased. This prevents the metal conductive layer 400*c* from separating from a predetermined position bonded to the heating roller 1 and breaking.

The gap 403 decreases consumption and break of the foamed rubber layer 400*b* caused by thermal expansion and shrinkage, and solves the nip width fluctuation problem caused by deformation of the metal conductive layer 400*c*.

Further, as the foamed rubber layer 400*b* is not bonded to the center part 402 of the metal conductive layer 400*c*, the stress by adhesion is decreased, consumption and break of the foamed rubber layer 400 are decreased, and a long life is maintained.

The end part 401 having the thickness D4 may be formed as one body by using a method of evaporating a metal member having the thickness equivalent to the difference between D3 and D4 on a cylindrical metal member with the length L1 and thickness D3, or a method of bonding with an adhesive.

Embodiment 5

Next, detailed explanation will be given on still another example of the heating roller 1 with reference to FIG. 9.

As described above, the heating roller 1 has a core rod 1*a*, a solid rubber layer 1*d*, and a mold release layer 1*e*. A foamed rubber layer 500*b* and metal conductive layer 500*c* are provided outside the core rod 1*a*.

Figure 9:
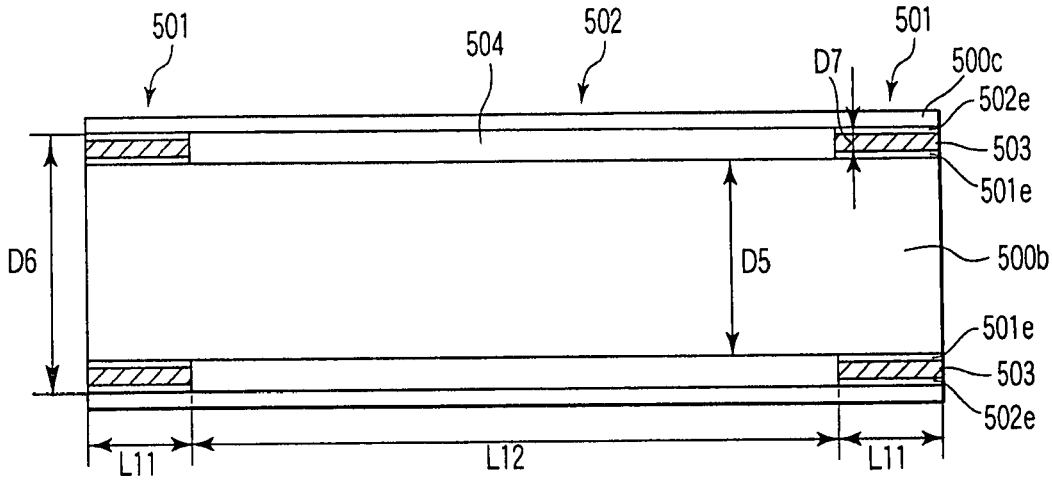
FIG. 9 is a diagram explaining still another example of the roller applicable to the fixing apparatus shown in FIG. 1.

FIG. 9 is a cross section of the foamed rubber layer 500*b* and metal conductive layer 500*c* in the axial direction of the heating roller 1.

The foamed rubber layer 500*b* has a certain outside diameter D5 in the axial direction of the heating roller 1.

The metal conductive layer 500*c* is a cylindrical endless member having certain outside and inside diameters D6 in the axial direction of the heating roller 1. The thickness of the metal conductive layer 500*c* is preferably 40 μm.

The inside diameter D6 is longer than the outside diameter D5. In this embodiment, the inside diameter D6 is 39.7 mm, and the outside diameter D5 is 39.3 mm. Therefore, a gap is generated when the foamed rubber layer 500*b* is provided inside the metal conductive layer 500*c*.

The heating roller 1 includes an end area 501 located at both ends in the axial direction, and a center area 502 located between the end area 501. The end area 501 has the length L11 determined in the above-mentioned predetermined range. The center area 502 has the length L12 determined in the above-mentioned predetermined range.

In the end area 501, a sleeve (spacer) 503 is placed between the foamed rubber layer 500*b* and metal conductive layer 500*c*. The sleeve 503 may be made cylindrical having the length L11. However, the sleeve 503 is not limited to cylindrical, but may be rectangular having a certain thickness, length L11, and height of diameter D5. In this case, the rectangular sleeve 503 is rounded and contained between the foamed rubber layer 500*b* and metal conductive layer 500*c*.

The diameter and thickness D7 of the sleeve 503 are calculated from the difference between the outside diameter D5 and inside diameter D6, and 200 μm in this embodiment.

The material of the sleeve 503 includes preferably a resin such as polyimide difficult to be influenced by deformation by heat and thermal expansion and shrinkage, and may include a metal used for the metal conductive layer 500*c*.

The sleeve 503 is bonded to the foamed rubber layer 500*b* and metal conductive layer 500*c*, by using a heat-resistant adhesive, for example. There, the rubber layer 500*b* is connected to the sleeve 503 via an adhesive layer 501*e*. The metal conductive layer 500*c* is connected to the sleeve 503 via an adhesive layer 502*e*. Namely, the foamed rubber layer 500*b* and metal conductive layer 500*c* are not directly bonded.

Thus, a gap 504 is formed in the center area 502 of the heating roller 1, between the foamed rubber layer 500*b* and metal conductive layer 500*c*. The gap 504 has the same height D7 as the thickness of the sleeve 503, in the radial direction of the heating roller 1. The height D7 is preferably maintained at about 200 μm by being supported by the sleeve 503.

Therefore, the foamed rubber layer 500*b* and metal conductive layer 500*c* bonded with the sleeve 503 are hard to be deformed by heat and hard to be influenced by thermal expansion and shrinkage. The foamed rubber layer 500*b* not bonded to the metal conductive layer 500*c* is hard to be restricted by the metal conductive layer 1*c* in thermal expansion and shrinkage. The center part of the foamed rubber layer 500*b* decreases the stress by adhesion. This decreases consumption and break of the foamed rubber layer 1*b*, and solve the nip width fluctuation problem caused by deformation of the metal conductive layer 1*c*.

Figure 10:
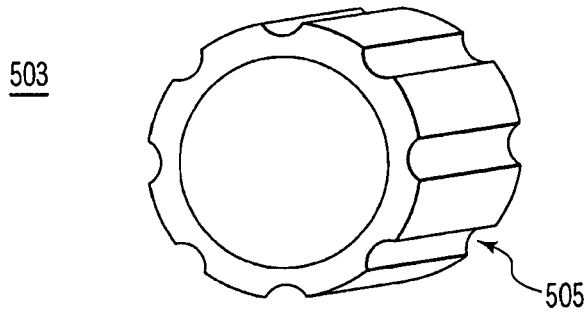
FIG. 10 is a drawing explaining an example of the sleeve shown in FIG. 9.

In the circumference of the sleeve 503, there is formed a plurality of air vents 505 or grooves with a cavity of predetermined length (e.g., the length L11) in the axial direction of the heating roller 1, as shown in FIG. 10. The air vent 505 is formed semicircular sinking toward the axis of the rotating roller, for example, in the circumference of the sleeve 503. The air vent 505 guides the heat existing in the gap 504 to the outside of the gap 504. The metal conductive layer 1*c* is bonded to the area of the sleeve 503 where the air vent 505 is nor formed, by using a heat-resistant adhesive, for example.

Therefore, the heat existing in the gap 504 is discharged through the air vent 505. This decreases consumption and break of the foamed rubber layer 500*b* caused by thermal expansion and shrinkage, and solves the nip width fluctuation problem caused by deformation of the metal conductive layer 1*c*.

Figure 11:
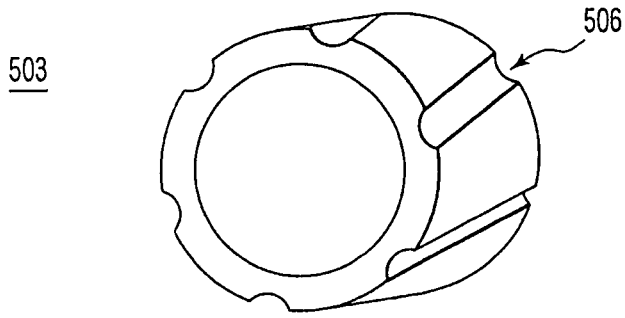
FIG. 11 is a drawing explaining another example of the sleeve shown in FIG. 9.

Further, in the circumference of the sleeve 503, as shown in FIG. 11, there is formed a plurality of air vents 506 which has a predetermined length (e.g., the distance L11 in the axial direction of the sleeve 503) in the axial direction of the heating roller 1, and cuts the circumference of the sleeve 503 linearly with a predetermined inclination against the axial direction of the heating roller 2. Like the above-mentioned air vent 505, the air vent 506 guides the heat existing in the gap 504 to the outside of the gap 504.

Of course, the heat value required for fixing is ensured by adjusting the discharged heat volume by controlling the size of the gap 504.

Embodiment 6

Next, detailed explanation will be given on still another example of the heating roller 1 with reference to FIG. 12.

As described above, the heating roller 1 has a solid rubber layer 1*d*, and a mold release layer 1*e*. The heating roller includes also a core rod 600*a*, and a foamed rubber layer 600*b* and metal conductive layer 600*c* provided outside the core rod 600*a*.

Figure 12:
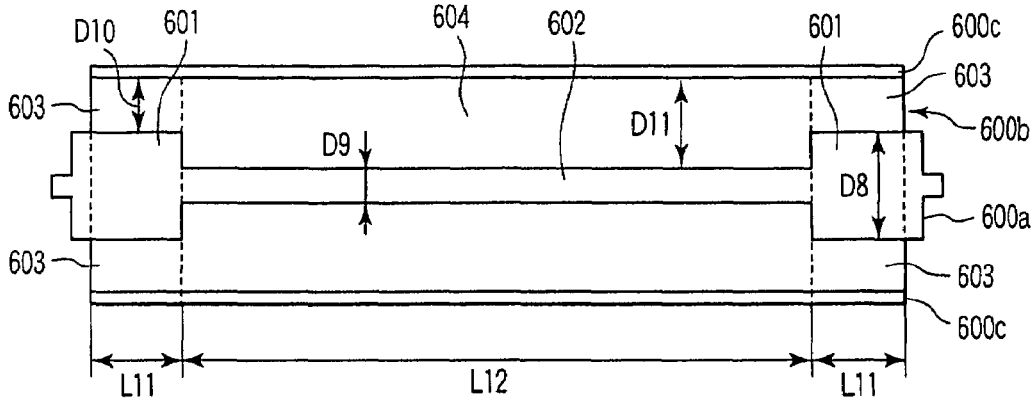
FIG. 12 is a diagram explaining still another example of the roller applicable to the fixing apparatus shown in FIG. 1.

FIG. 12 is a cross section of the foamed rubber layer 600*b* and metal conductive layer 600*c* in the axial direction of the heating roller 1.

The core rod 600*a* has an end part 601 which is located at both ends in the axial direction and has the outside diameter D8, and a center part 602 which is located between the end part 601 and has the outside diameter D9. The outside diameter D8 is longer than the outside diameter D9. The difference between the outside diameters D8 and D9 will be explained in detail later, and is determined in the range ensuring the nip width larger than a certain value to obtain a high quality image according to the material of the foamed rubber layer 600*b*. The difference is preferably 1 mm or more.

The end part 601 has the length L11 determined in the above-mentioned predetermined range. The center part 602 has the length L12 determined in the above-mentioned predetermined range. The core rod 600*a* preferably has a hollow part inside, for example, a hollow part penetrating the inside of the end part 601 and center part 602.

The foamed rubber layer 600*b* is a cylindrical foamed body having a certain outside diameter in the axial direction, and is bonded to the core rod 600*a* by using a heat-resistant adhesive, for example. It is also permitted to form a foamed body in the core rod 600*a* with a certain outside diameter. In this embodiment, the outside diameter of the foamed rubber layer 600*b* is 39.7 mm.

The foamed rubber layer 600*b* has an end part 603 which has the length L11 and is located outside the end part 601 of the core rod 600*a*, and a center part 604 which has the length L12 and is located outside the center part 602 of the core rod 600*a*.

The end part 603 of the foamed rubber layer 600*b* has the thickness D10. The center part 604 of the foamed rubber layer 600*b* has the thickness D11 thicker (larger) than the thickness D10. The metal conductive layer 600*c* which is a cylindrical endless member having certain outside and inside diameters is bonded to the whole surface of the foamed rubber layer 600*b* with a heat-resistant adhesive or the like.

The center part 604 of the foamed rubber layer 600*b* is made thick to absorb the repulsion to the pressure of the pressing roller 2, or the resistance corresponding to the hardness of the core rod 600*a*. Therefore, the center part 604 having the thickness D11 thicker than D10 is small in the hardness compared with the end part 603. Namely, the center part 604 can be deformed flexibly.

Therefore, the center part 604 ensures the nip width larger than a certain value to obtain a high quality image.

Figure 13:
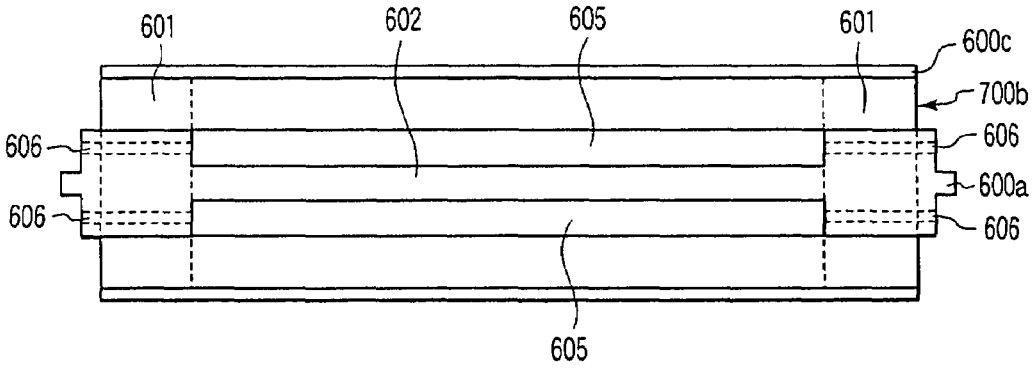
FIG. 13 is a diagram explaining still another example of the roller applicable to the fixing apparatus shown in FIG. 1.

As shown in FIG. 13, the heating roller 1 may have a cylindrical foamed rubber layer 700*b* having certain outside and inside diameters in the axial direction of the heating roller 1, between the core rod 600*a* and metal conductive layer 600*c*.

The foamed rubber layer 700*b* is bonded only to the end part 601 of the core rod 600*a* with a heat-resistance adhesive or the like. The metal conductive layer 600*c* is bonded to the whole surface of the foamed rubber layer 700*b* with a heat-resistant adhesive or the like. A gap 605 corresponding to the difference between the outside diameters D8 and D9 of the core rod 600*a* is formed between the foamed rubber layer 700*b* and the center part 602 of the core rod 600*a*.

The gap 605 absorbs the repulsion corresponding to the hardness of the core rod 600*a*, and the center part of the foamed rubber layer 600*b* ensures the nip width larger than a certain value to obtain a high quality image.

In the end part 601 of the core rod 600*a*, a plurality of air vents 606 having a predetermined length (e.g., the distance L11 in the axial direction of the end part 601) in the axial direction of the heating roller 1 is formed. The air vent 606 guides the heat existing in the gap 605 to the outside of the gap 605.

This solves the problem that the hardness of the heating roller 1 is increased by thermal expansion, and the nip width larger than a certain value is not ensured.

The metal conductive layer 600*c* shown in FIG. 12 may be bonded only to the end part 603 of the foamed rubber layer 600*b*. The metal conductive layer 600*c* shown in FIG. 13 may be bonded only to the end of the foamed rubber layer 700*b*, or the area of the length L11 from the longitudinal end of the foamed rubber layer 700*b*. The core rod 600*a*, foamed rubber layer 700*b* and metal conductive layer 600*c* are bonded only in the area having the length L11 determined in the above-mentioned predetermined range.

Therefore, the stress by adhesion is decreased, and consumption and break of the foamed rubber layer 600*b* are decreased, and a long life is maintained.

Embodiment 7

Next, detailed explanation will be given on still another example of the heating roller 1 with reference to FIGS. 14 to 17.

Figure 14:
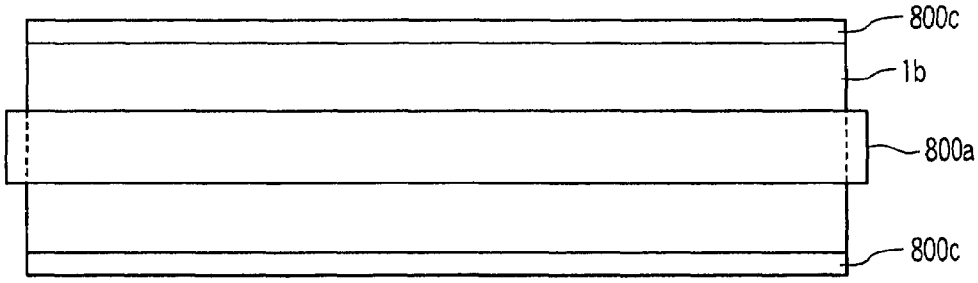
FIG. 14 is a diagram explaining still another example of the roller applicable to the fixing apparatus shown in FIG. 1.

As shown in FIG. 14, the heating roller 1 has a foamed rubber layer 1*b*, a core rod 800*a* provided inside the foamed rubber layer 1*b*, and a metal conductive layer 800*c* provided outside the foamed rubber layer 1*b*. A solid rubber layer 1*d* and a mold release layer 1*e* may be formed outside the metal conductive layer 800*c*.

Figure 15:
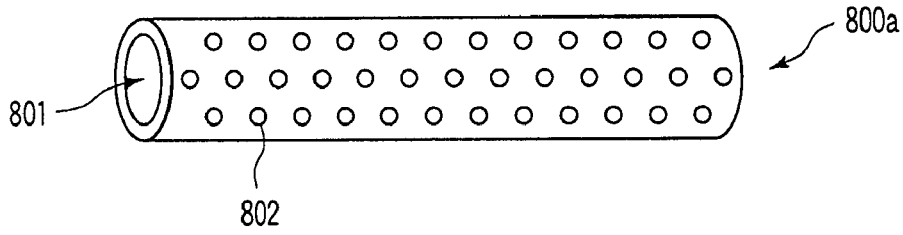
FIG. 15 is a drawing explaining an example of the core rod shown in FIG. 14.

FIG. 15 is a perspective view of the core rod 800*a*.

The core rod 800*e* is shaped cylindrical, and has a hollow part 801 inside. The hollow part 801 is connected to the outside of the circumference through the air vent 802 formed in the core rod 800*a*.

The circumference of the core rod 800*a* is bonded to the foamed rubber layer 1*b* with a heat-resistant adhesive or the like. When the metal conductive layer 800*c* is restricted or a stress such as a pressure is applied from the pressing roller 2, the air included in the foamed rubber layer 1*b* is guided from the hollow part 801 to the outside of the heating roller 1 through the air vent 802. As the thermally expanded air in the foamed rubber layer 1*b* is guided from the hollow part 801 to the outside of the heating roller 1, the hardness of the heating roller 1 is prevented from increasing to larger than the value to ensure the required nip width.

Figure 16:
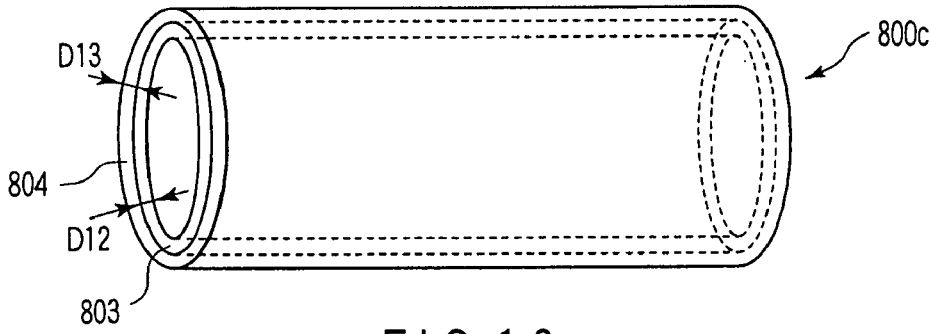
FIG. 16 is a drawing explaining an example of the metal conductive layer shown in FIG. 14.

FIG. 16 is a perspective view of the metal conductive layer 800*c*.

The metal conductive layer 800*c* is a cylindrical endless member having certain outside and inside diameters. The metal conductive layer 800*c* includes a first layer 803 made of a first material, and a second layer 804 made of a first material and provided around the first layer 803.

The first layer 803 is shaped cylindrical with the thickness D12. The second layer 804 is shaped cylindrical with the thickness D13. The thickness D12 and D13 are selected optionally according to the first and second materials, and the hardness of the metal conductive layer 800*c* is adjusted. The metal conductive layer 800*c* preferably has a small hardness to reduce the difference with the hardness of the foamed rubber layer 1*b* for preventing consumption and break of the foamed rubber layer 1*b* caused by the stress.

In this embodiment, the first material is nickel, and the second material is copper. The first and second layers 803 and 804 are formed in 20 μm. Combination of the first and second materials is not limited to this. The materials can be optionally selected from nickel, stainless steel, aluminum, copper, and aluminum-stainless steel composite material. The first and second layers 803 and 804 may by bonded in the boundary surface by using a heat-resistant adhesive or the like, or may be formed as one body by evaporation.

The metal conductive layer 800*c* is bonded to the whole surface of the foamed rubber layer 1*b* with a heat-resistant adhesive or the like. The metal conductive layer 800*c* may be bonded only to the end of the foamed rubber layer 1*b*, or the area of the length L11 from the longitudinal end of the foamed rubber layer 1*b*.

In this embodiment, the metal conductive layer 800*c* is explained as a 2-layer structure, but three or more layers are permitted. The materials of each layer can be optionally selected from nickel, stainless steel, aluminum, copper, and aluminum-stainless steel composite material.

Figure 17:
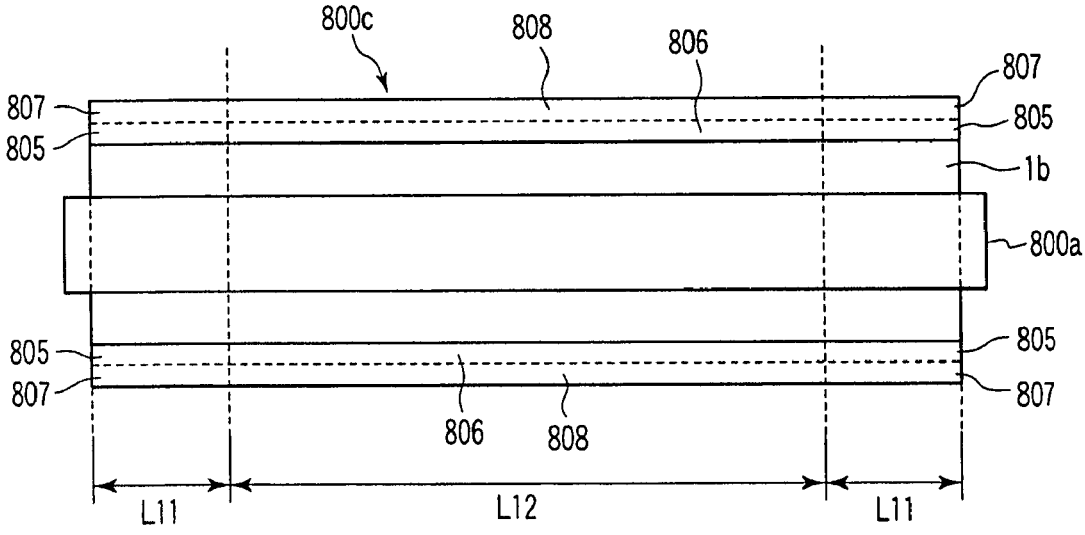
FIG. 17 is a diagram explaining an example of the metal conductive layer shown in FIG. 14.

The metal conductive layer 800*c* includes a first inside layer 805 formed at both ends in the length direction of the heating roller 1, a second inside layer 806 formed at the center of the length direction, a first outside layer 807 formed outside the inside the first layer 805, and a second outside layer 808 formed outside the second inside layer 806, as shown in FIG. 17. Each layer is made of respective predetermined material. The first and second inside layers 805 and 806, and the first and second outside layers 807 and 808 may be bonded in the boundary surface by using a heat-resistant adhesive or the like, or may be formed as one body by evaporation or the like.

The first inside layer 805 and first outside layer 807 include the area (first area) having the length L11 determined in the above-mentioned predetermined range. The second inside layer 806 and second outside layer 808 includes the area (second area) having the length L12 determined in the above-mentioned predetermined range. Increased hardness is demanded in the second area where the high bonding strength (fixing strength) to the foamed rubber layer 1*b* is required, and decreased hardness is demanded in the first area where the nip width larger than a certain value is required. Therefore, by selecting optionally the composing material, the hardness of the metal conductive layer 800*c* can be adjusted, as described above.

In this embodiment, the first inside layer 805, second inside layer 806 and first outside layer 807 are made of nickel, and the second outside layer 808 is made of copper. Each layer is formed cylindrical with the thickness 20 μm. Therefore, the hardness of the first area is larger than the hardness of the second area.

Combination of materials of the first and second inside layers 805, 806 and the first and second outside layers 807,

808 is not limited to this. The materials can be optionally selected from nickel, stainless steel, aluminum, copper, and aluminum-stainless steel composite material. The first and second inside layers 805, 806 and the first and second outside layers 807, 808 may by bonded in the boundary surface by using a heat-resistant adhesive or the like, or may be formed as one body by evaporation or the like.

The metal conductive layer 800*c* including two or more layers described above may be provided outside the above-mentioned core rod 1*a* and foamed rubber layer 1*b*.

The core rod, foamed rubber layer and metal conductive layer explained in the above embodiments 1-7 can be optionally combined and used. For example, the foamed rubber layer 1*b* shown in FIG. 3 may be combined with the core rod 800*e* and metal conductive layer 800*c* shown in FIG. 14 or FIG. 16, in the heating roller 1. The foamed rubber layer 300*b* shown in FIG. 5 may be combined with the core rod 8000*e* and metal conductive layer 800*c* shown in FIG. 14 or FIG. 16, in the heating roller 1.

The configuration of the heating roller 1 explained in the above embodiments 1-7 may be applied to the pressing roller 2.

Embodiment 8

Next, detailed explanation will be given on still another example of the heating roller with reference to FIGS. 18A to 18G.

Figure 18A:
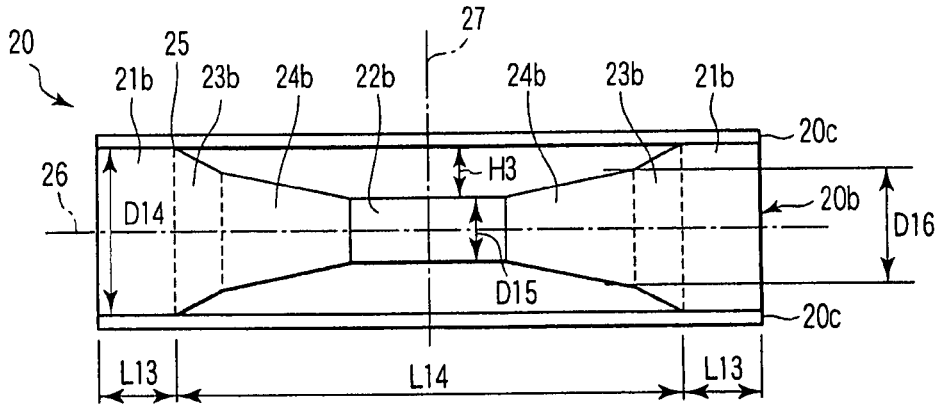
FIGS. 18A-18G are drawings explaining still another examples of the roller applicable to the fixing apparatus shown in FIG. 1.

FIG. 18A is a cross section of the heating roller in the axial direction.

A heating roller 20 has a metal conductive layer 20*c* and a foamed rubber layer 20*b*. The core rod 1*a* may be provided inside the foamed rubber layer 20*b*.

The solid rubber layer 1*d* and mold release layer 1*e* may be provided outside the metal conductive layer 20*c*.

The metal conductive layer 20*c* has the internal circumference with the inside diameter D14.

The foamed rubber layer 20*b* has an end part 21*b* having the largest outside diameter D14, and a center part 22*b* having the smallest outside diameter D15.

Inside the end part 21*b*, a cone 23*b* whose outside diameter becomes small in the axial direction toward the center is formed. At both ends of the center part 22*b*, a cone 24*b* whose outside diameter becomes small in the axial direction toward the center is formed. Explaining in details, the outside diameter of the cone 23*b* becomes small gradually from the outside diameter D16 to the minimum outside diameter D15. The outside diameter D16 has a predetermined value smaller than the outside diameter D14, and larger than the outside diameter D15.

The circumferences of the cone 23*b* and 24*b* are conical (tapered) whose outside diameter becomes smaller at a predetermined rate, as shown linearly in the cross section view. The surface like this shape is described as a tapered surface hereinafter. The surface having a certain outside diameter in the axial direction, like the end part 21*b* and center part 22*b*, is described as a cylindrical surface hereinafter.

The end part 21*b* has the length L13 in the axial direction, and its circumference contacts the metal conductive layer 20*c*. The metal conductive layer 20*c* and end part 21*b* are bonded in the whole surface or a part of the contacting part by using a heat-resistant adhesive, for example.

The foamed rubber layer 20*b* has the length L14 in the axial direction in the part not contacting the metal conductive layer 20*c*. (4) The length L14 is the sum of the lengths of the center part 22*b* and cones 23*b* and 24*b* in the axial direction, and is in the range that the length L13 is ensured by (3) sufficient bonding strength.

A step 25 is formed between the end part 21*b* and cone 23*b*. When a predetermined pressure is supplied from the pressing roller 2, a step may be formed on the surface of the metal conductive layer 20*c*. Thus, the step 25 is preferably out of the image forming area.

Therefore, the metal conductive layer 20*c* is not bonded to the cones 23*b* and 24*b* of the foamed rubber layer 20*b*, and a gap is formed between the foamed rubber layer except the end part 21*b* and metal conductive layer 20*b*. The foamed rubber layer 20*b* is not bonded to the end part 21*b* of the metal conductive layer 20*c* and the cones 23*b* and 24*b*, and a gap is formed between them. In this embodiment, the outside diameters D14 and D15 have at least the difference H3, 0.1-2 mm in diameter (i.e., 0.05-1 mm in radius).

The foamed rubber layer 20*b* is symmetric with respect to the axis 26, and is a circle having a predetermined radius in the cross section vertical to the axis. The foamed rubber layer 20*b* is also symmetric with respect to the centerline 27 in the radial direction.

The end part and cone as a foamed rubber layer may be formed as one body, or may be composed of a plurality of members. When a plurality of members is combined, the combined parts may be bonded, or a little gap may be provided. In this case, by using the axis shown in FIG. 15, an air passage can be formed between the above gape and the outside of the roller, and the air pressure in the roller can be adjusted.

As to a material to be transferred conveyed between the heating roller and pressing roller in being supplied with a predetermined heat and pressure, there is a problem that extension caused by thermal expansion is not absorbed, and the surface is wrinkled.

The heating roller 20 of this embodiment includes the foamed rubber layer 20*b* which has the outside diameter maximum at both ends and becoming small toward the center. When a material to be transferred passes between the pressing roller 2 which supplies a predetermined tension, the speed of conveying the material to be transferred becomes faster in the outside than at the center.

Therefore, the material to be transferred placed between the heating roller 20 and pressing roller 2, and moved by rotation of the rollers passes between the rollers just like being pulled toward both ends in the axial direction, and generation of wrinkles is restricted. Further, when the center of the material to be transferred passes near the centerline 915, generation of deflected stress can be prevented, and the material to be transferred is moved in the direction vertical to the axis, and a wrinkle is more difficult to generate.

The center part 22*b*, and cones 23*b* and 24*b* not bonded to the metal conductive layer 20*c* reduce the influence of thermal expansion and shrinkage caused by the heat from the metal conductive layer 20*c*. Namely, when thermal expansion occurs, consumption and break of the foamed rubber layer 20*b* caused by restriction by the metal conductive layer 20*c* is decreased and the hardness ensuring the nip width larger than a certain value is maintained to obtain a high quality image. Further, the stress by adhesive is decreased, consumption and break of the foamed rubber layer 20*b* is decreased, and a long life is maintained.

The metal conductive layer 20*c* may have the inside diameter lower than the outside diameter D14 of the end part 21*b*, and may have a foamed rubber layer 20*b* inside provided by so-called tight fit, as explained later by referring to FIGS. 20A and 20B. Namely, the foamed rubber layer 20*b* may contact in the area defined by the length L14, or contact the metal conductive layer 20*c* in a part of or whole circumference. The similar effects can be obtained with these configurations.

Now, explanation will be given on modifications of the foamed rubber layer 20*b*.

Figure 18B:
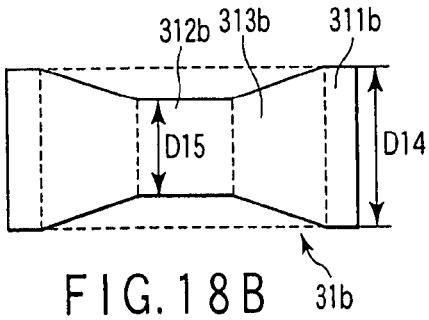

As shown in FIG. 18B, a foamed rubber layer 31*b* includes an end part 311*b* having a cylindrical surface with the maximum outside diameter D14, a center part 312*b* having a cylindrical surface with the minimum outside diameter D15, and a cone part 313*b* which is located between the end part 311*b* and center part 312*b* and has a tapered surface with the outside diameter decreased gradually toward the center part 312*b*. The layer is symmetric with respect to the axis and centerline of the radius.

Figure 18E:
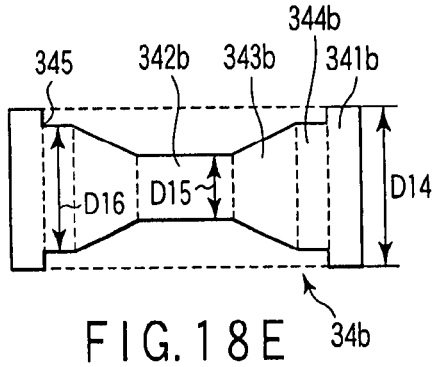
Figure 18C:
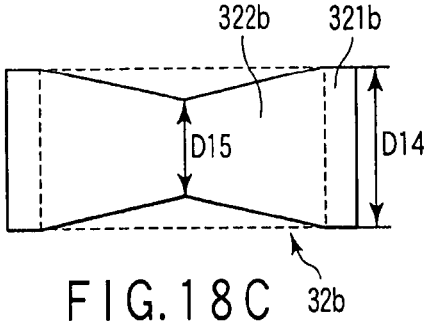

As shown in FIG. 18C, a foamed rubber layer 32*b* has an end part 321*b* having a cylindrical surface with the maximum outside diameter D14, and the cone part 322*b* having a tapered surface with the outside diameter decreased gradually toward the minimum outside diameter D15. The layer is symmetric with respect to axis and the centerline of the radius.

Figure 18F:
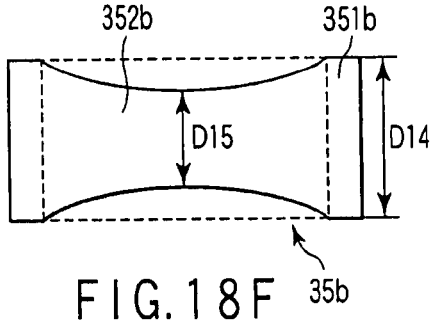
Figure 18D:
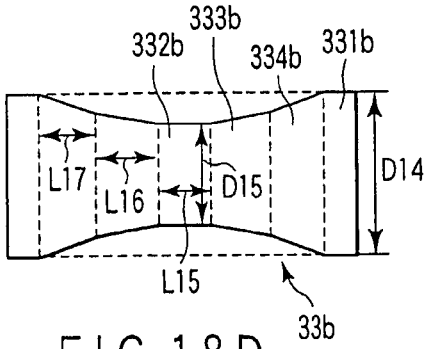

As shown in FIG. 18D, a foamed rubber layer 33*b* has an end part 331*b* having a cylindrical surface with the maximum outside diameter D14, a center part 332*b* having a cylindrical surface with the minimum outside diameter D15, and cone parts 333*b* and 334*b* which are located between the end part 331*b* and center part 332*b* and have a tapered surface with the outside diameter decreased gradually toward the center part 332*b*. The center part 332*b* has a predetermined length L15, the cone 333*b* has a predetermined length L16, and the cone 334*b* has a predetermined length L17 toward the axial direction, to decrease gradually the outside diameter of the foamed rubber layer 33*b* toward the center. The layer is symmetric with respect to axis and the centerline of the radius.

As shown in FIG. 18E, a foamed rubber layer 341*b* has an end part 341*b* having a cylindrical surface with the maximum outside diameter D14, a center part 342*b* having a cylindrical surface with the minimum outside diameter D15, a cone part 343*b* which is located at both ends of the center part 342*b* and has a tapered surface with the outside diameter decreased gradually toward the center part 342*b*, and a cylindrical part 344*b* which is located outside the cone part 343*b* and has a cylindrical surface with the outside diameter D16 smaller than the outside diameter D14 and larger than the outside diameter D15. A step 345 is formed between the cylindrical part 344*b* and end part 341*b*. A step 955 is preferably located at a position causing no defects in image forming, for example, at a predetermined position in the paper non-passing area. The step is symmetric with respect to the axis and the centerline of the radius.

As shown in FIG. 18F, a foamed rubber layer 35*d* has an end part 351*b* having a cylindrical surface with the maximum outside diameter D14, and a center part 352*b* having the minimum outside diameter D15 at the center in the axial direction. The circumference of the center part 352*b* has the outside diameter decreased gradually from both ends toward the center at a predetermined rate, as shown by the curve in the cross section. The surface like this shape will be explained as a curved surface. The layer is symmetric with respect to the axis and the centerline of the radius.

Figure 18G:
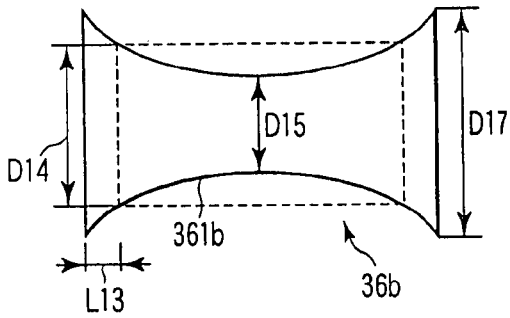

As shown in FIG. 18G a foamed rubber layer 36*b* has a curved surface 361*b* which has the maximum outside diameter D17 at both ends in the axial direction, the minimum outside diameter D15 at the center, and the outside diameter decreased gradually toward the center at a predetermined rate, as shown by the curve in the cross section. The layer is symmetric with respect to the axis and the centerline of the radius.

Unlike the foamed rubber layers 31*b*-35*b*, the foamed rubber layer 36*b* is not formed to have a cylindrical surface as a predetermined area contacting the metal conductive layer 20*c* at both ends. But, a predetermined area to contact the metal conductive layer 20*c* is ensured by so-called tight fit by making the area of the length L13 in the axial direction from both ends, for example, larger than the inside diameter D14 of the metal conductive layer 20*c* provided outside.

The foamed rubber layers 31*b*-36*b* are bonded in apart of or whole surface of the part contacting the metal conductive layer 20*c* by using a heat-resistant adhesive or the like, when they are provided inside the metal conductive layer 20*c*.

Like the end part 21*b*, the end parts 311*b*, 321*b*, 331*b*, 341*b* and 351*b* have preferably the length L13 in the axial direction, and has the length L14 between both ends.

As explained above, the foamed rubber layers 31*b*-36*b* have the outside diameter maximum at both ends and decreased gradually toward the center, and the speed of conveying a material to be transferred is faster in the outside than the center.

Embodiment 9

Figure 19A:
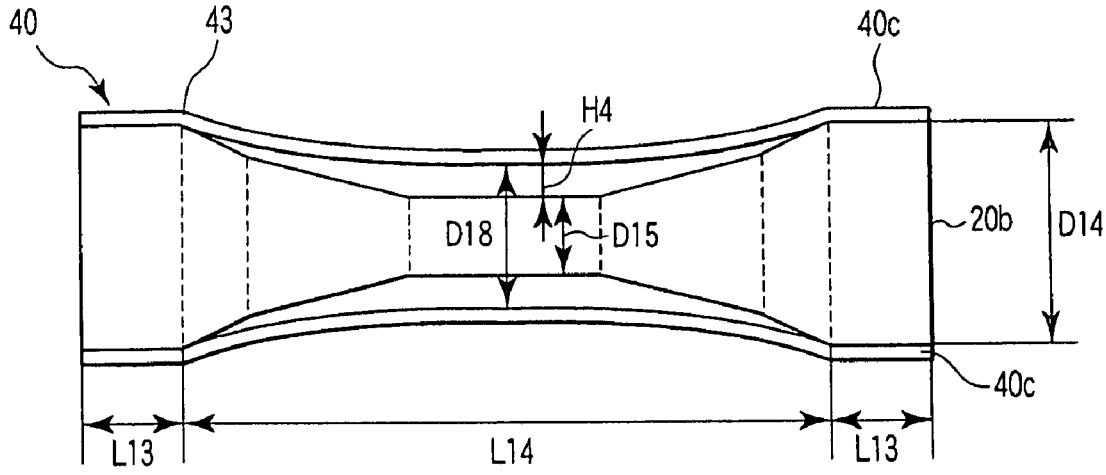
FIGS. 19A-19C are drawings explaining still another examples of the roller applicable to the fixing apparatus shown in FIG. 1.
Figure 19B:
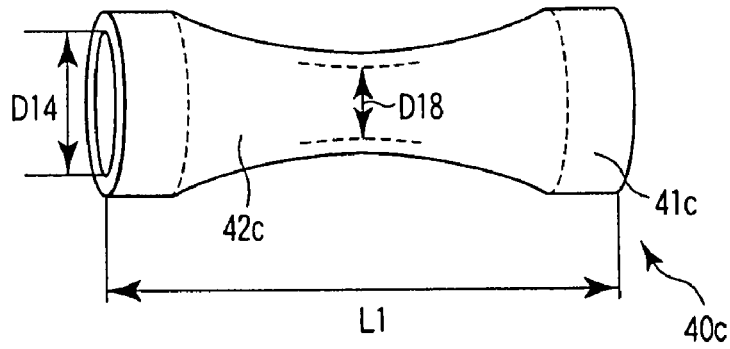
Figure 19C:
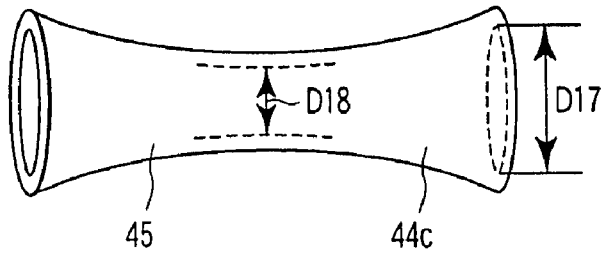

Next, explanation will be give on still another example of the heating roller by referring to FIGS. 19A-19C.

A heating roller 40 has a metal conductive layer 40*c*, and foamed rubber layer 20*b* explained before, for example, as a foamed rubber layer having the outside diameter maximum at both ends and decreased gradually toward the center. The core rod 1*a* may be provided inside the foamed rubber layer 20*b*, and the solid rubber layer 1*d* and mold release layer 1*e* may be provided outside the metal conductive layer 40*c*.

FIG. 19A is a cross section of the foamed rubber layer 20*b* and metal conductive layer 40*c* in the axial direction. FIG. 19B is a schematic perspective view of the metal conductive layer 40*c*.

The foamed rubber layer 20*b* has the outside diameter decreased gradually from the maximum outside diameter D14 of the end part to the minimum outside diameter D15 of the center part.

As shown in FIG. 19B, a metal conductive layer 40*c* includes an end part 41*c* having a cylindrical surface with the maximum internal diameter D14, and a center part 42*c* having the minimum internal diameter D18 at the center in the axial direction. The center part 42*c* includes a curved surface with the inside diameter decreased gradually from both ends toward the minimum inside diameter D18. The metal conductive layer 40*c* is formed to have a certain thickness, 40 μm for example, in the axial direction. Therefore, like the internal circumference, the external circumference of the metal conductive layer 40*c* is formed to have a curved surface with the outside diameter maximum at both ends and decreased gradually toward the center.

The inside diameter D18 of the metal conductive layer 40*c* is larger than the minimum outside diameter D15 of the foamed rubber layer 20*b*.

As shown in FIG. 19A, the end part 41*c* of the metal conductive layer 40*c* has the length L13 in the axial direction, and contacts the foamed rubber layer 20*b* in the inside circumference. The metal conductive layer 40*c* and foamed rubber layer 20*b* are bonded in a part of or whole surface of the contacted part by using a heat-resistant adhesive, for example.

The center part 42*c* of the metal conductive layer 40*c* has the length L14 in the axial direction, and is preferably not bonded to the foamed rubber 20*b*, and has a gap therebetween.

In this embodiment, the inside diameter D18 and outside diameter D15 have a difference H4 of at least 0.1-2 mm in diameter (e.g., 0.5-1 mm in radius). The sum of the end part 41*c* and center part 42*c*, or the length of the metal conductive layer 40*c* in the axial direction is L1, and is preferably 30 mm, for example.

A boundary 43 is formed between the end part 41*c* and center part 42*c*. This may cause defective image forming in the material to be transferred passing between the boundary and pressing roller 2, when the pressure is supplied from the pressing roller 2. Thus, it is preferable to set L14 to a predetermined length, so that the boundary 43 is located at a predetermined position where defective image forming does not occur. As explained above, the length L14 is the length longer than the paper passing area (4), and may include paper passing area and paper non-passing area. Further, the length L13 may be determined in a rage ensuring sufficient bonding strength (3).

As describe above, the heating roller 40 has a circumference with different outside diameter in the axial direction, and has the outside diameter maximum at both ends and decreased gradually toward the center. With this structure, the speed of conveying the material to be transferred is faster at the end (outside) than the center (inside) in the axial direction. Therefore, the conveyed transferred material passes between the heating roller 40 and pressing roller 2 just like being pulled toward both ends in the axial direction, suppressing generation of a wrinkle.

Next, explanation will be given on still another example of metal conductive layer maximum at both end and decreased gradually toward the center by referring to FIG. 19C.

A metal conductive layer 44*c* has a circumference consisting only of a curved surface 45.

The metal conductive layer 44*c* may have inside the foamed rubber layer 36*b* shown in FIG. 18G, for example. The foamed rubber layer 36*b* is bonded to the end of the metal conductive layer 44*c* defined by the length L13, and is preferably not contacted to the center part of the metal conductive layer 44*c* including at least paper passing area, and has a gap therebetween.

With this configuration, a boundary is not formed on the surface of the metal conductive layer 44*c*, and defective image forming does not occur.

In this embodiment, the foamed rubber layer 20*b* is taken as an example, but it is permitted that one of the foamed rubber layer 31*b*-36*b* shown in FIG. 18B-18F is provided inside the metal conductive layer 40*c*.

Of course, the metal conductive layers 40*c* and 44*c* are symmetric with respect to the axis and the centerline in the radial direction.

Embodiment 10

Next, explanation will be given on still another example of a heating roller by referring to FIGS. 20A-20E.

Figure 20A:
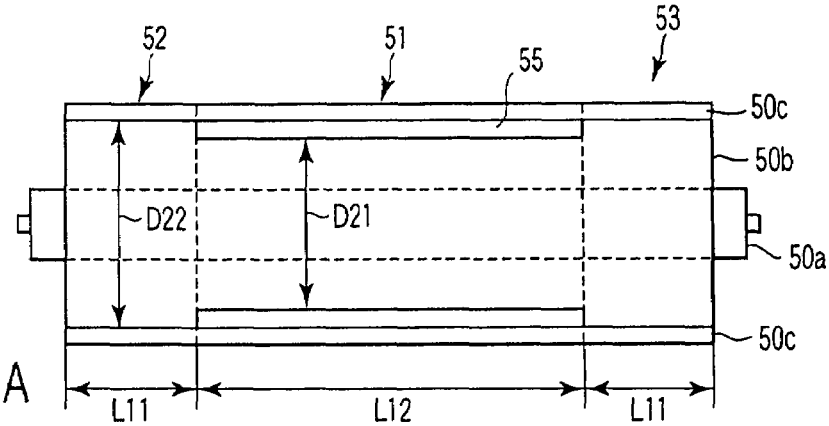
FIGS. 20A-20E are drawings explaining still another examples of the roller applicable to the fixing apparatus shown in FIG. 1.

As shown in FIG. 20A, a heating roller 50 has a center part 51 having the length L12 in the axial direction, and end parts 52 and 53 which are located at both ends of the center part 51 and have the length L11. The center part 51 has a third hardness, and the end parts 52 and 53 have a fourth hardness larger (harder) than the third hardness.

Figure 20B:
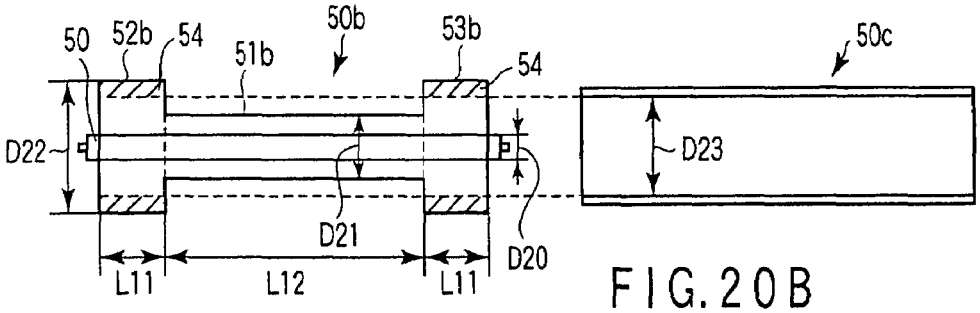

The heating roller 50 has a core rod 50*a*, a foamed rubber layer 50*b* and a metal conductive layer 50*c*, as shown in FIG. 20B.

The core rod 50*a* has the outside diameter D20 uniformly in the axial direction.

The foamed rubber layer 50*b* consists of a center foamed rubber layer 51*b* having the minimum outside diameter D21 and the length L12 corresponding to a center part 51, and end foamed rubber layers 52*b* and 53*b* having the maximum outside diameter 22. The end formed rubber layers 52*b* and 53*b* have the length L11 corresponding to the end parts 52 and 53, respectively.

Therefore, the center foamed rubber layer 51*b* has the even thickness (D21-D20)/2 in the circumferential direction, and the end foamed rubber layers 52*b* and 53*b* have the even thickness (D22-D20)/2 in the circumferential direction.

The metal conductive layer 50*c* has the inside diameter D23 uniformly in the axial direction.

The heating roller 50 having the different hardness at the center and end parts has a foamed rubber layer with the different outside diameter at the center and end parts.

Next, explanation will be given on the relationship between the foamed rubber layer 50*b* and metal conductive layer 50*c*.

As shown in FIG. 20B, the outside diameter D22 of the end foamed rubber layers 52*b* and 53*b* is larger than the inside diameter D23 of the metal conductive layer 50*c*, and the outside diameter D21 of the center foamed rubber layer 51*b* is smaller than the inside diameter D23. Namely, an inequality of D21<D23<D22 is established.

Therefore, the end foamed rubber layers 52*b* and 53*b* are fit with the metal conductive layer 50*c* by tight fit, and have the fourth hardness that is a predetermined hardness corresponding to an interference 54 that is the difference between them (D22-D23)/2. A gap 55 (FIG. 20A) that is the difference between them (D23-D21)/2 is formed between the center foamed rubber layer 51*b* and metal conductive layer 50*c*. The configuration having a pap at the center and tight fitted at the end will be explained as a type α.

Figure 20C:
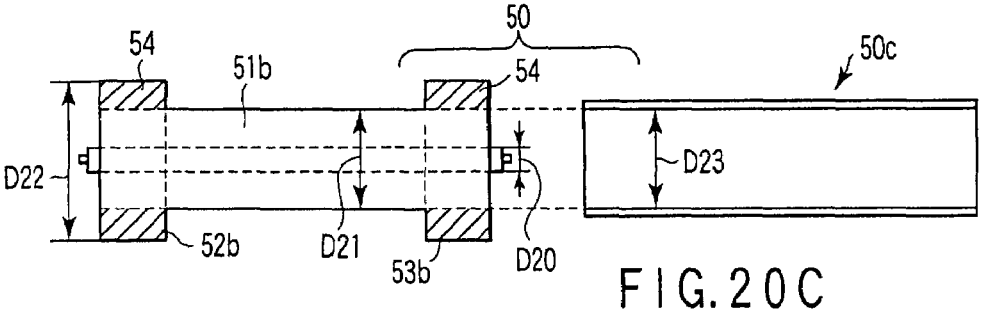

Contrarily, as shown in FIG. 20C, when the outside diameter D21 of the center foamed rubber layer 51*b* is equal to the inside diameter D23 of the metal conductive layer 50*c*, no gap is generated between the metal conductive layer 50*c* and foamed rubber layer, but the end parts 52 and 53 of the heating roller 50 has the fourth hardness larger than the third hardness of the center part 51 corresponding to the interference. Namely, an equation D21=D23<D22 is established. The configuration having no pap at the center and fit tightly at the end will be explained as a type β.

Figure 20D:
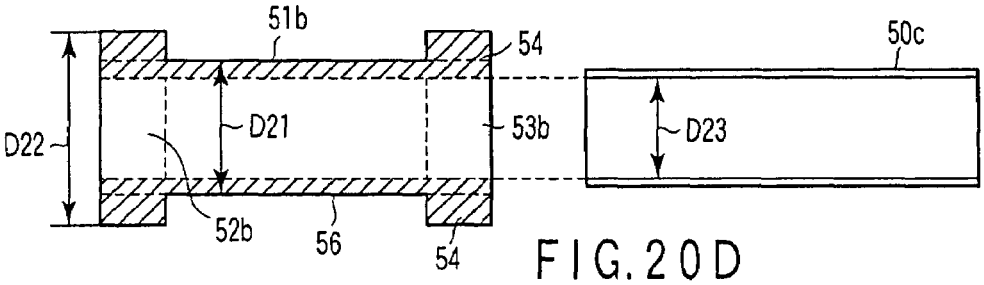

Further, as shown in FIG. 20D, when the outside diameter D21 of the center foamed rubber layer 51*b* is larger than the inside diameter D23 of the metal conductive layer 50*c*, no gap is generated between the metal conductive layer 50*c* and foamed rubber layer, and the third hardness and fourth hardness of the center part of the heating roller 50 have the difference corresponding to the difference between the interference 54 at the end part and the interference 56 at the center part. Namely, an inequality of D23<D21<D22 is established. The configuration fit tightly at the center and end parts will be explained as a type γ.

Figure 20E:
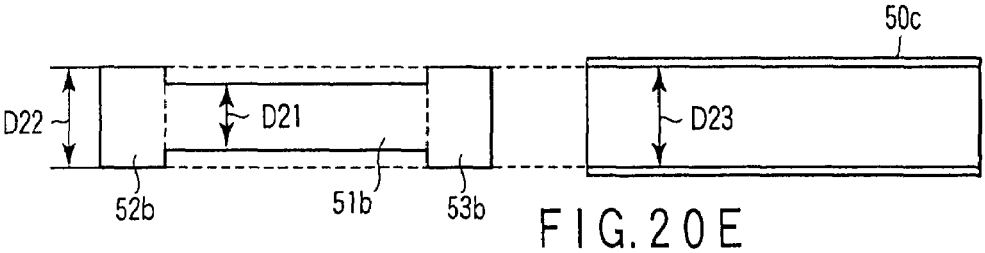

As shown in FIG. 20E, the outside diameter D22 of the end foamed rubber layers 52*b* and 53*b* is the same as the inside diameter D23 of the metal conductive layer 50*c*, a gap is formed between the metal conductive layer 50*c* and center foamed rubber layer 51*b*, and the center part 51 of the heating roller 50 has the third hardness smaller than the fourth hardness of the end part corresponding to the difference between the outside diameter D21 of the center part and outside diameter D22 of the end part of the foamed rubber layer. Namely, an inequality of D21<D23<D22 is established. The configuration having a gap at the center and fit without gap at the end will be explained as a type δ.

In any one of the heating roller of the above mentioned types α-δ, the center part 51 has the third hardness smaller than the fourth hardness of the end parts 52 and 53. The third hardness varies depending on the hardness of the foamed rubber layer 50*b* itself and the volume of the gap formed between the metal conductive layer 50*c*, in a range to ensure the nip width larger than a certain value to obtain a high quality image.

The fourth hardness varies depending on the volume of the clearance 54 in case of tight fit, because the end foamed rubber layers 52*b* and 53*b* are compressed by the metal conductive layer 50*c* which gives restriction from the outside, and gives a predetermined pressure from the inside to the metal conductive layer 50*c*. The clearance 54 is expressed by the largeness in the radial direction compressed by fitting.

TABLE 1

| | End part A | Center part B | End part C |
|---|---|---|---|
| Sample 1 | E66 | E63 | E66 |
| Sample 2 | E63 | E58 | E63 |
| Sample 3 | E64 | E61 | E64 |
| Sample 4 | E64 | E60 | E64 |

In this embodiment, as shown in Table 1, samples 1-3 are prepared as a foamed rubber layer, and the hardness of the center part and both ends of a heating roller is measured with an E-type durometer prescribed as a method of testing the hardness of vulcanized rubber or thermoplastic rubber in JIS6253-1997. The inside diameter of all metal conductive layers is 45 mm, and the outside diameter of all core metals is 30 mm.

The sample 1 is the type β. The foamed rubber layer 50*b* is formed to have 45.0 mm in the outside diameter D21 of the center part, and 46.0 mm in the outside diameter D22 of the end part. The end foamed rubber layers 52*b* and 53*b* are fit with the metal conductive layer 50*c* with a clearance of 0.5 mm.

The sample 2 is the type δ. The foamed rubber layer 50*b* is formed to have 43.4 mm in the outside diameter D21 of the center part, and 45.0 mm in the outside diameter D22 of the end part. The center foamed rubber layer 51*b* is fit loose with the metal conductive layer with a gape of 0.8 mm.

The sample 3 is the type α. The foamed rubber layer 50*b* is formed to have 44.4 mm in the outside diameter D211 of the center part, and 45.3 mm in the outside diameter D22 of the end part. Namely, the center foamed rubber layer 51*b* is fit loose with the metal conductive layer with a gap of 0.3 mm, and the end foamed rubber layers 52*b* and 53*b* are fit with the metal conductive layer 50*c* with an interference of 0.15 mm.

The sample 4 is the type α. The foamed rubber layer 50*b* is formed to have 44.0 mm in the outside diameter D211 of the center part, and 45.3 mm in the outside diameter D22 of the end part. Namely, the center foamed rubber layer 51*b* is fit loose with the metal conductive layer with a gap of 0.5 mm, and the end foamed rubber layer 53*b* is fit with the metal conductive layer 50*c* with an interference of 0.15 mm.

Table 1 shows the hardness A of an end part 52, hardness B of a center part 51 and hardness C of an end part 53 of the samples 1-4 in the ordinary temperature state (25° C., here) with no pressure supplied from a pressing roller and no heat supplied from a heating mechanism. The hardness A-C is a mean value of a plurality of points (4 points, here) in the circumferential direction of a foamed rubber layer having an even outside diameter. The metal conductive layer 50*c* and foamed rubber layer 50*b* are bonded at an ordinary temperature and atmospheric pressure. Thus, atmospheric air exists in a gap formed between the metal conductive layer 50*c* and foamed rubber layer 50*b*. When the metal conductive layer 50*c* and foamed rubber layer 50*b* are bonded at a high pressure, the foamed rubber layer 50*b* may be collapsed (1), the air is expanded in the gap (2), and the hardness at the center of the roller is increased higher than the hardness at the end, and the gap size (height) is changed with time (3). Contrarily, when the metal conductive layer 50*c* and foamed rubber layer 50*b* are bonded at a low pressure, the metal conductive layer 50*c* is pushed to the inside by the external atmospheric pressure, and the surface becomes uneven (1), and the gap size (height) is changed with time (2).

Figure 21:
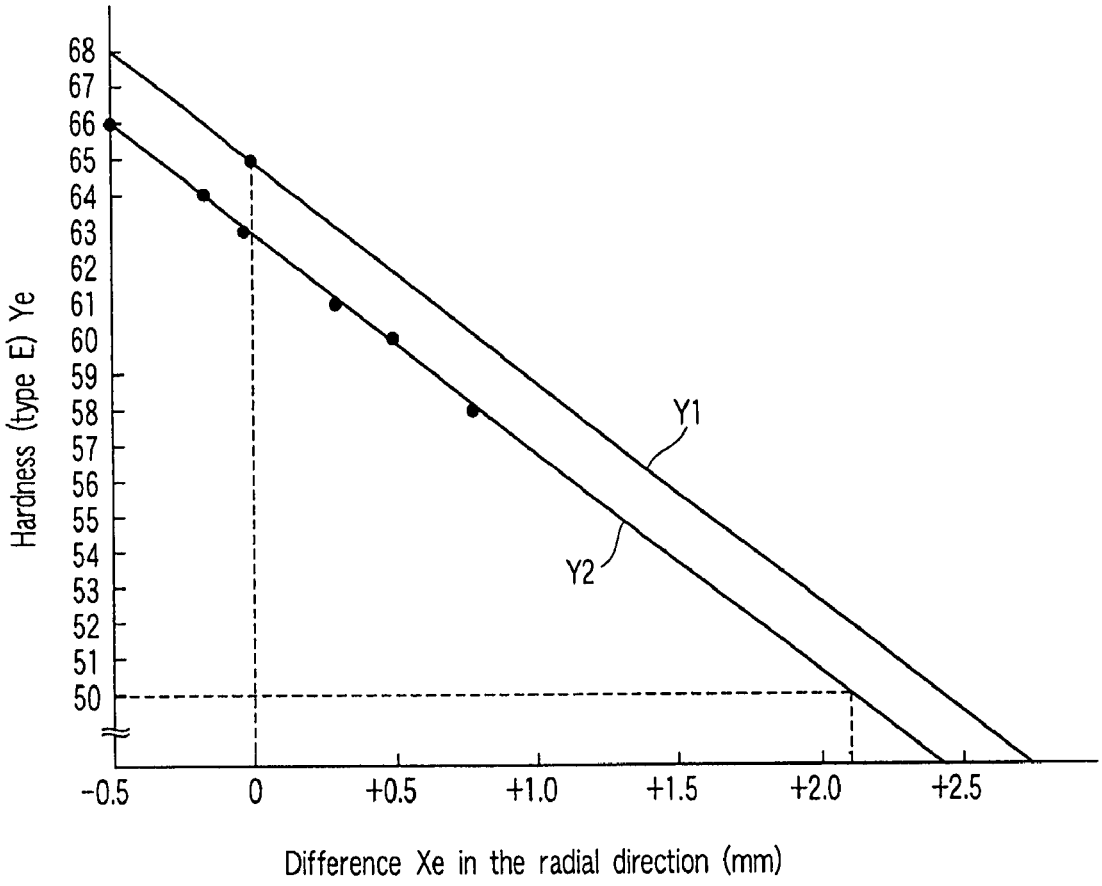
FIG. 21 is a graph explaining the hardness of the roller applicable to the fixing apparatus shown in FIG. 1.

FIG. 21 shows the result of measurement. The vertical axis indicates the hardness Ye measured with an E-type durometer, and the horizontal axis indicates the difference between the metal conductive layer and foamed rubber layer in the radial direction Xe=(D23−D21)/2 (mm). In the horizontal axis, "0" indicates the state the metal conductive layer and foamed rubber layer are fit closely without a gap, "+" indicates the loose fit state with a gap therebetween, and "−" indicates the tight fit state.

When the inside diameter D23 of a metal conductive layer is the same as the outside diameter D20 of a core rod, the hardness of a heating roller can be changed by changing the outside diameter D21 of the center part and the outside diameter D22 of the end part of a foamed rubber layer in a predetermined range. A heating roller has a predetermined hardness depending on the size of interference in case of tight fit, and the size of gap in case of loose fit. Namely, even if a heating roller of any type of α-δ is used, a specific hardness difference is held depending on the difference between the inside diameter D23 of a metal conductive layer and the outside diameter D20 of a core rod and the relationship with the thickness of a foamed rubber layer provided therebetween. In this embodiment, the foamed rubber layer 50*b* is formed to have the outside diameter difference of 0.5 mm, and the hardness of the center part of a roller is E3 smaller than the hardness of the end part of a roller in the state that the foamed rubber layer 50*b* is provided inside the metal conductive layer 50*c*. In the present invention, the hardness difference between the center and end parts of a roller is preferably E1 or more, and the level difference of the foamed rubber layer 50*b* is preferably 0.16 mm or more. In other words, when the level difference of the foamed rubber layer 50*b* is less than 0.16 mm, the hardness difference is smaller than E1. The hardness measured outside the roller is largely influenced by the hardness of the metal conductive layer 50*c*. Thus, if the level difference of the foamed rubber layer 50*b* is very small, there is little difference in the hardness in the axial direction of the roller. Therefore, when the level difference of the foamed rubber layer 50*b* is less than 0.16 mm, the hardness difference in the axial direction of the roller is very small.

When the inside diameter of a metal conductive layer is changed, a roller with the hardness in the above-mentioned range can be realized by changing the outside diameter of a core rod by the equivalent value and making the thickness of a foamed conductive layer the same as that in this embodiment, for example, by setting the outside diameter D20 of a core rod to 25 mm when the inside diameter D23 of a metal conductive layer is 40 mm.

The heating roller 50 may have a foamed rubber layer having the outside diameter maximum at both ends and decreased gradually toward the center, as the foamed rubber layers 20*b* and 31*b*-36*b* explained hereinbefore by referring to FIGS. 18A-18G.

The center part 51 of the heating roller 50 may be in the range to ensure the nip width larger than a predetermined value to obtain a high quality image. For example, it is permitted that a gap of 2.1 mm is formed between the foamed rubber layer 50*b* having the outside diameter D21 of 40.8 mm and the metal conductive layer 50*c* having the inside diameter of 45.0 mm, and the hardness is E50, as shown in FIGS. 20A and 21. Both rollers may be formed in the sizes corresponding to FIG. 21, and in the hardness range of E50-58.

Embodiment 11

Next, explanation will be given on still another example of a heating roller by referring to FIGS. 22A-22D.

Figure 22A:
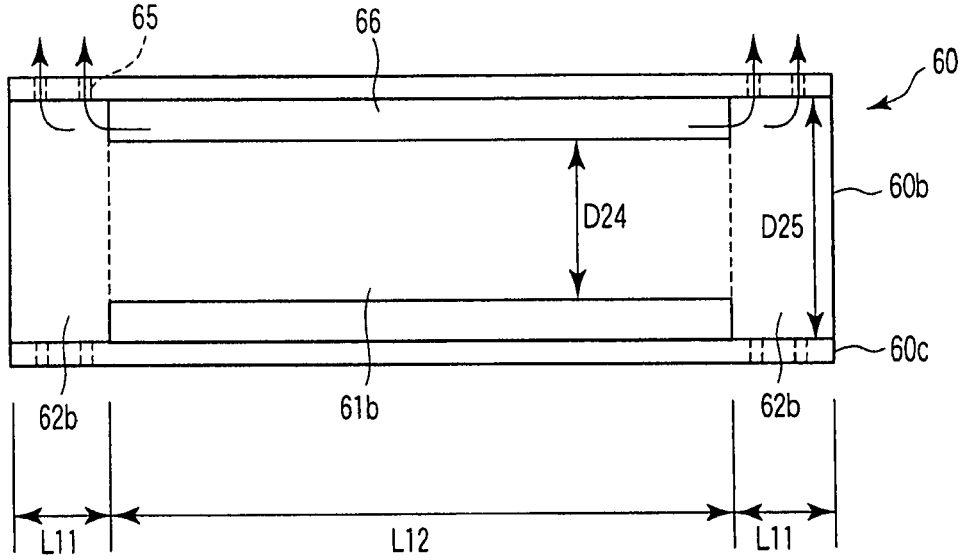
FIGS. 22A-22D are drawings explaining still another examples of the roller applicable to the fixing apparatus shown in FIG. 1.

As shown in FIG. 22A, a heating roller 60 has a foamed rubber layer 60*b* and a metal conductive layer 60*c*.

The foamed rubber layer 60*b* includes a center part 61*b* having the outside diameter D24, and an end part 62*b* having the outside diameter D25 larger than the outside diameter D24. In this embodiment, the outside diameter D24 is 39.3 mm, and the outside diameter D25 is 39.7 mm.

Figure 22B:
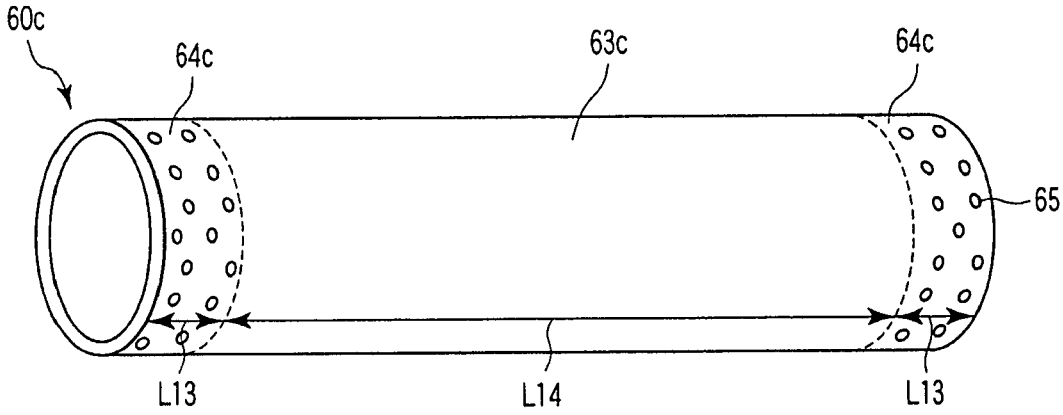

As shown in FIG. 22B, a metal conductive layer 60*c* has a center part 63*c* having the length L14 in the axial direction, and an end part 64*c* having the length L13 in the axial direction. In the end part 64*c*, a plurality of air vents 85 is formed to guide the air inside the metal conductive layer 60*c* to the outside. In this embodiment, the air vent 65 is preferably formed in a substantial circle with a diameter of 1 mm.

The end part 64*c* of the metal conductive layer 60*c* is bonded to a part of the circumference of the foamed rubber layer 60*b* provided inside not to clog the air vent 65 by using a heat-resistant adhesive, for example.

The metal conductive layer 60*c* is preferably not bonded to the center part 61*b* of the foamed rubber layer 60*b*, and has a gap 66 therebetween. The air in the gap 66 or near the metal conductive layer 60*c* and foamed rubber layer 60*b* is guided to the outside of the air vent 65 through the end part 62*b* of the foamed rubber layer 60*b*.

Therefore, even the inside air is expanded by the heat of the metal conductive layer 60*c*, the air is guided outside through the air vent 65.

The length L14 of the center part 63*c* of the metal conductive layer 60*c* is longer than a paper passing area (4), and may include a paper passing area and a paper non-passing area. The length L13 of the end part 64*c* may be the length including the area defined as a paper non-passing area (1), and may be determined in the range to ensure sufficient bonding strength (3). The length L11 of the end part 62*b* of the foamed rubber 60*b* is longer than the length L14, and may include the area that defective image forming does not occur including a part of the paper passing area (2), in addition to the paper non-passing area. As described above, the air vent 65 is preferably formed out of the paper passing area to prevent defective image forming.

Thus, even when the metal conductive layer 60*c* is heated, the hardness of the heating roller 60 is prevented from being increased by thermal expansion, and the hardness to ensure the nip width larger than a certain value can be held to obtain a high quality image.

Figure 22C:
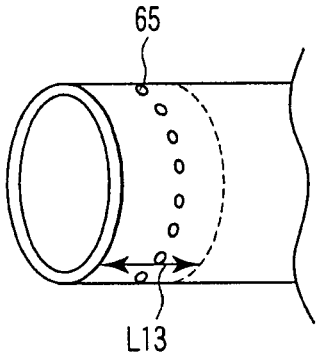
Figure 22D:
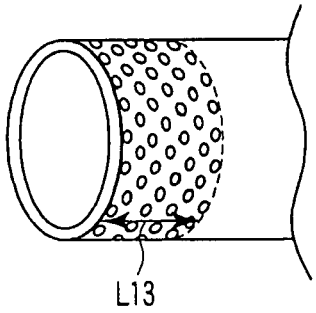

The air vent 65 may be formed in plural number as shown in FIG. 22B, it may also be formed in rows in the radial direction as shown in FIG. 22C, or the end part 64*c* may be formed like a mesh. At least end part 62*b* of the foamed rubber layer 60*b* is preferably formed in continuous foams in which each foam is connected.

In this embodiment, the heating roller 60 has been explained as the foamed rubber layer 60*b* having the cylindrical surface with the even circumference in the axial direction. However, the present invention is not limited to this. For example, one of the foamed rubber layers 20*b* and 31*b*-36*b* shown in FIGS. 18A-18F may be provided inside the metal conductive layer 60*c*.

Embodiment 12

Next, explanation will be given on still another example of a heating roller by referring to FIGS. 23A, 23B, 24A and 24B.

FIG. 23 is a schematic perspective view of a foamed rubber layer 70*b*.

The foamed rubber layer 70*b* consists of an end part 71*b* having the outside diameter D1, and a center part 72*b* having the outside diameter D2 smaller than the outside diameter D1, and has at least one air vent 73 penetrating the end part 71*b* and center part 72*b* in the axial direction.

Figure 23A:
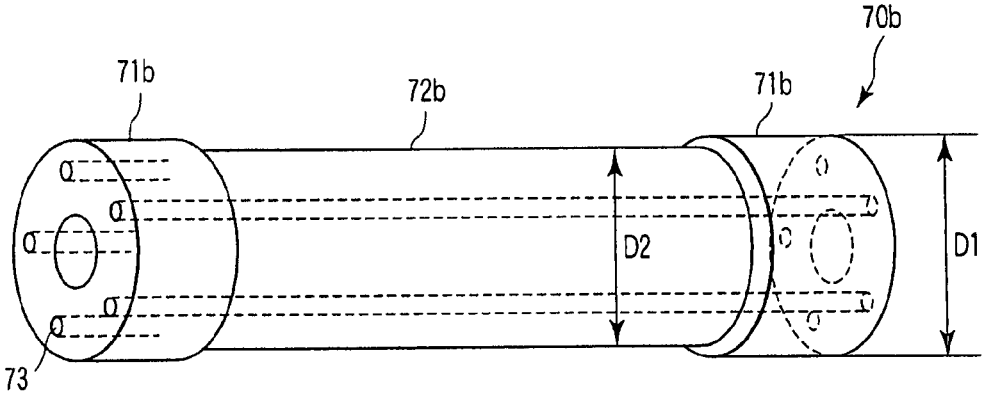
FIGS. 23A and 23B are drawings explaining still another examples of the roller applicable to the fixing apparatus shown in FIG. 1.
Figure 23B:
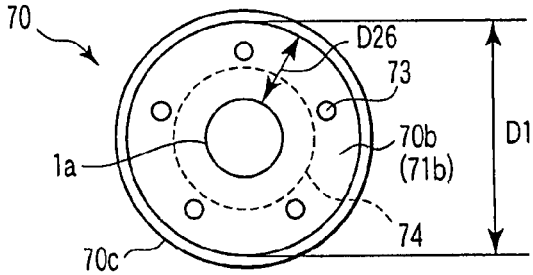

FIG. 23B is a cross section of the heating roller 70 including the foamed rubber layer 70*b*, at the end part 71*b*.

The heating roller 70 has a metal conductive layer 70*c* having uniform inside diameter D1, a foamed rubber layer 70*b* provided inside the metal conductive layer 70*c*, and a core rod 1*a* provided inside the foamed rubber layer 70*b*.

The end part 71*b* contacts the metal conductive layer 70*c*, and is bonded in the whole surface or a part of the contacting area by using a heat-resistant adhesive, for example.

The center part 72*b* is preferably not contacting the metal conductive layer 70*c*, and has a gap therebetween.

The end part 71*b* has the thickness D26, or the distance from the core rod 1*a* to the metal conductive layer 70*c*, and has a air vent 73 in a predetermined area.

The air vent 73 is formed outside the dividing line 74 and inside the outside diameter D2, or in the area having the diameter larger than the dividing line 74 and smaller than the outside diameter D2. The dividing line 74 is the line to divide for explanation the outside that the heat from the heated metal conductive layer 70*c* is easy to transmit, and the inside that the heat is substantially hard to transmit. For example, the dividing line is defined as a circle with a radius smaller than the outside diameter D1 of the end part 71*b* by the length equivalent to 50% of the thickness D26.

Thus, the air in the foamed rubber layer 70*b* heated by the metal conductive layer 70*c* can be efficiently exhausted to the outside of the heating roller 70.

Therefore, even if when the metal conductive layer 70*c* is heated, the heating roller 70 is prevented from increasing in the hardness caused by thermal expansion, and maintains the hardness to ensure the nip width larger than a certain value to obtain a high quality image.

In this embodiment, the heating roller 70 has been explained as the foamed rubber layer 70*b* having the cylindrical surface with the even circumference in the axial direction. However, the present invention is not limited to this. For example, one of the foamed rubber layers 20*b* and 31*b*-36*b* shown in FIGS. 18A-18F may be provided inside the metal conductive layer 70*c*.

Next, explanation will be given on another example of a foamed rubber layer having an air vent penetrating in the axial direction by referring to FIGS. 24A and 24B.

Figure 24A:
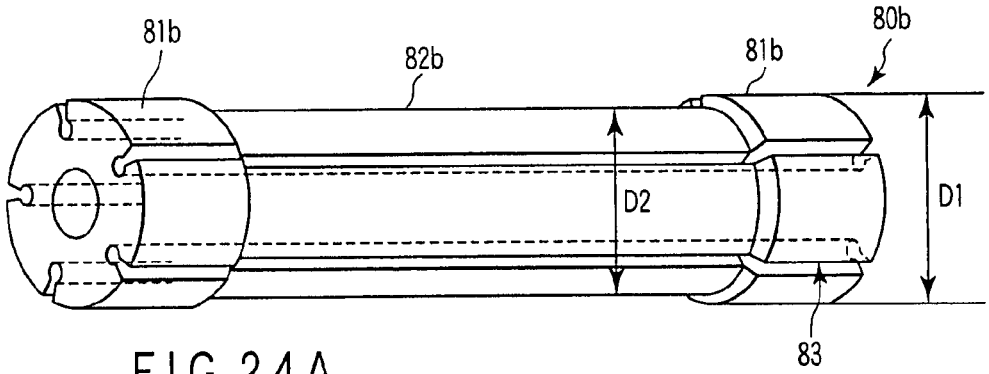
FIGS. 24A and 24B are drawings explaining still another examples of the roller applicable to the fixing apparatus shown in FIG. 1.

FIG. 24A is a schematic perspective view of a foamed rubber layer 80*b*.

The foamed rubber layer 80*b* consists of an end part 81*b* having the outside diameter D1, and a center part 82*b* having the outside diameter D2 smaller than the outside diameter D1, and has at least one air vent 83 penetrating the end part 81*b* and center part 82*b* in the axial direction, and notching the circumference of the end part 81*b* and center part 82*b*.

Figure 24B:
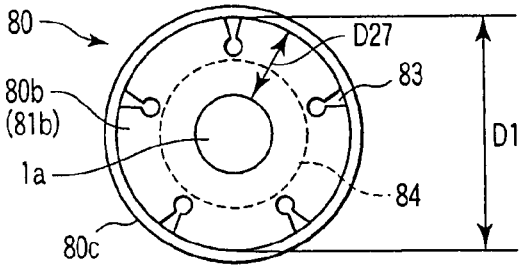

FIG. 24B is a cross section of the heating roller 80 including the foamed rubber layer 80*b*, at the end part 81*a*.

The heating roller 80 has a metal conductive layer 80*c* having uniform inside diameter D1, a foamed rubber layer 80*b* provided inside the metal conductive layer 80*c*, and a core rod 1*a* provided inside the foamed rubber layer 80*b*.

The end part 81*b* contacts the metal conductive layer 80*c*, and is bonded in the whole surface or a part of the contacting area by using a heat-resistant adhesive, for example.

The center part 82*b* is preferably not contacting the metal conductive layer 80*c*, and has a gap therebetween.

The end part 81*b* has the thickness D27, or the distance from the core rod 1*a* to the metal conductive layer 80*c*, and has a air vent 83 formed in the area having the diameter larger than a dividing line 84. The air vent 83 reaches the circumference of the end part 81*b* and center part 82*b*. The dividing line 84 is defined as a circle with a radius smaller than the outside diameter D1 of the end part 81*b* by the length equivalent to 50% of the thickness D27.

Thus, the air in the gap formed between the metal conductive layer 80*c* and the center part of the foamed rubber layer 80*b* can be guided to the outside more efficiently through the air vent 83.

The air vent 83 may be a simple notch.

In this embodiment, the heating roller 80 has been explained as the foamed rubber layer 80*b* having the cylindrical surface with the even circumference in the axial direction. However, the present invention is not limited to this. For example, one of the foamed rubber layers 20*b* and 31*b*-36*b* shown in FIGS. 18A-18F may be provided inside the metal conductive layer 70*c*.

Embodiment 13

Next, explanation will be given on still another example of a heating roller by referring to FIGS. 25A and 25B.

Figure 25A:
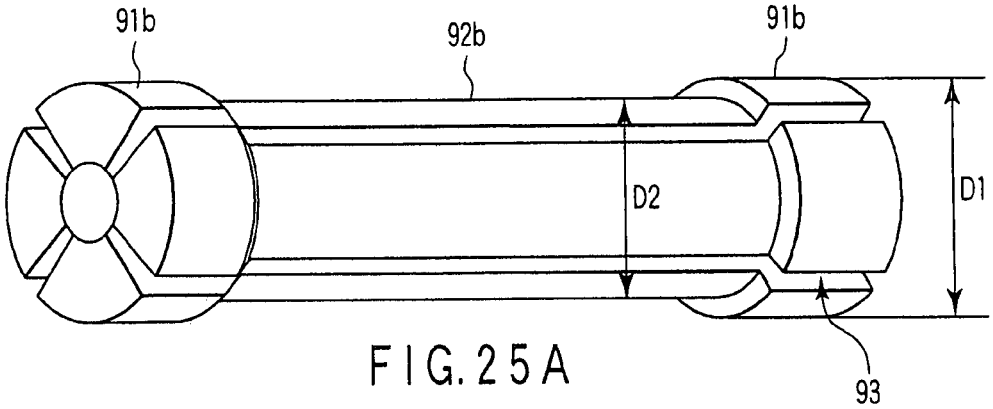
FIGS. 25A and 25B are drawings explaining still another examples of the roller applicable to the fixing apparatus shown in FIG. 1.

FIG. 25A is a schematic perspective view of a foamed rubber layer 90*b*.

The foamed rubber layer 90*b* consists of an end part 91*b* having the outside diameter D1, and a center part 92*b* having the outside diameter D2 smaller than the outside diameter D1, and has at least one air vent 93 penetrating the end part 91*b* and center part 92*b* in the axial direction, and notching the internal and external circumferences of the end part 91*b* and center part 92*b*.

Figure 25B:
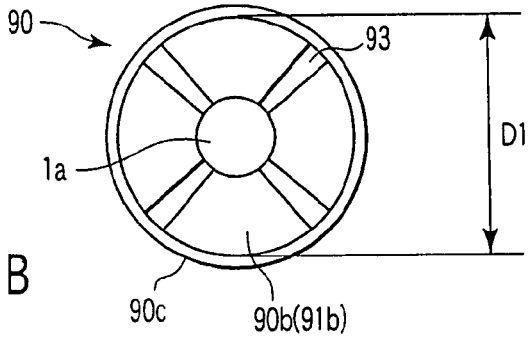

FIG. 25B is a cross section of the heating roller 90 including the foamed rubber layer 90*b*, at the end part 91*b*.

The heating roller 90 has a metal conductive layer 90*c* having uniform inside diameter D1, a foamed rubber layer 90*b* provided inside the metal conductive layer 90*c*, and a core rod 1*a* provided inside the foamed rubber layer 90*b* and holding the foamed rubber layer 90*b* by a predetermined bonding method.

The end part 91*b* contacts the metal conductive layer 90*c*, and is bonded in the whole surface or a part of the contacting area by using a heat-resistant adhesive, for example.

The center part 92*b* is preferably not contacting the metal conductive layer 90*c*, and has a gap therebetween.

The air vent 93 is a notch reaching from the internal circumference to the external circumference of the foamed rubber layer 90*b*. In other words, the air vent has the depth in the axial direction in the end par 91*b* and center part 91*b*, equivalent to the thickness of them.

Thus, the air in the gap formed between the metal conductive layer 90*c* and the center part 92*b* of the foamed rubber layer 90*b*, or the air inside the metal conductive layer 90*c* can be guided to the outside more efficiently through the air vent 93.

Therefore, even if when the metal conductive layer 90*c* is heated, the heating roller 90 is prevented from increasing in the hardness caused by thermal expansion, and maintains the hardness to ensure the nip width larger than a certain value to obtain a high quality image.

In this embodiment, the heating roller 90 has been explained as the foamed rubber layer 90*b* having the cylindrical surface with the even circumference in the axial direction. However, the present invention is not limited to this. For example, one of the foamed rubber layers 20*b* and 31*b*-36*b* shown in FIGS. 18A-18F may be provided inside the metal conductive layer 90*c*.

Embodiment 14

Next, explanation will be given on still another example of a heating roller by referring to FIGS. 26A and 26B.

Figure 26A:
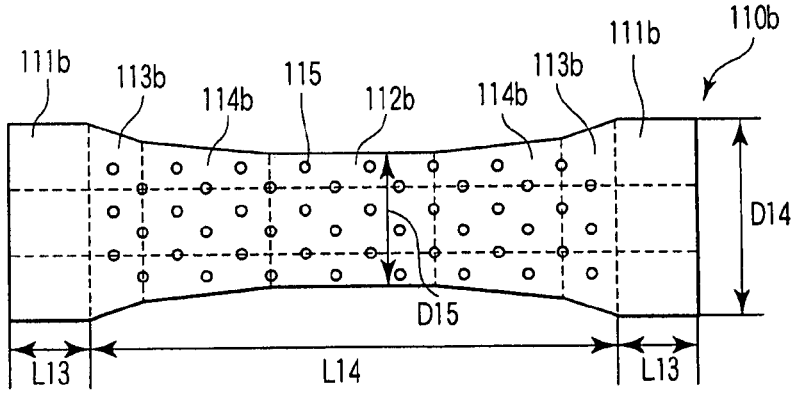
FIGS. 26A and 26B are drawing explaining still another examples of the roller applicable to the fixing apparatus shown in FIG. 1.
Figure 26B:
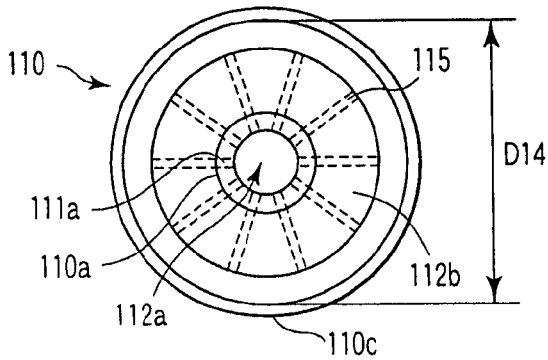

FIG. 26B is a cross section of a center part of a heating roller 110.

The heating roller 110 has a metal conductive layer 110*c* having uniform inside diameter D14, a foamed rubber layer 110*b* provided inside the metal conductive layer 110*c*, and a core rod 110*a* provided inside the foamed rubber layer 110*b*.

The core rod 110*a* has a hollow part 111*a* and a ventilation hole 112*a*, and is configured to connect the circumference side or the foamed rubber layer 110*b* and the outside or both end parts adjacent to the ventilation hole 112*a*. The core rod 110*a* may be configured like the core rod 800*a* explained with reference to FIG. 15, for example.

As shown in FIG. 26A, the foamed rubber layer 110*b* consists of an end part 111*b* having the maximum outside diameter D14, a center part 112*b* having the minimum outside diameter D15, and cone parts 113*b* and 114*b* having the outside diameter decreased gradually toward the center in the axial direction, and has a plurality of air vents 115 reaching from the internal circumference to the external circumference.

The end part 111*b* contacts the metal conductive layer 110*c*, and is bonded to the whole surface or a part of the contacted area by using a heat-resistant adhesive, for example.

The center part 112*b* is preferably not contacting the metal conductive layer 110*c*, and has a gap therebetween.

The air vent 115 penetrates the foamed rubber layer 110*b* in the radial direction, and connects the gap (near the metal conductive layer 110*c*) and the external circumference of the core rod 800*a*. The ventilation hole 111*a* of the core rod 800*a* connected with the air vent 115 can exhaust air to the outside through the hollow part 112*a*.

Thus, the air in the foamed rubber layer 110*b* heated by the metal conductive layer 110*c* can be efficiently exhausted to the outside of the heating roller 110.

The end part 111*b* is formed to have the length L13 in the axial direction. The center part 112*b* and cone parts 113*b* and 114*b* are formed to have the length L14, or the total length in the axial direction. As explained above, the length L14 is longer than the paper passing area (4), and may include the paper passing area and paper non-passing area, and may be determined in the range that the length L13 is ensured by sufficient bonding strength (3).

Therefore, the air vent 115 is formed at least in the paper passing area. As the air vent 115 is formed, the hardness of the center part 112*b* and cone parts 113*b* and 114*b* is decreased.

As a predetermined number and size of air vent 115 is formed in the paper passing area, the hardness to ensure the nip width larger than a predetermined value can be maintained.

The core rod 110*a* is not limited to the above-mentioned type. It is permitted to form a ventilation hole on the surface contacting the center part 112*b* and cone parts 113*b* and 114*b* according to the position of the air vent 115 of the foamed rubber layer 110*b*, or not to form a ventilation hole on the surface contacting the end part 111*b*. It is also permitted to make the whole surface like a mesh.

As the air vent 115 is formed in a predetermined number or size, the hardness of the heating roller 110 can be decreased. Further, when the foamed rubber layer 110*b* is composed of continuous foams in which foams are connected and air can be moved, the heating roller 2 supplies a pressure to exhaust air from the end part 111*b*. Thus, even a core rod having no ventilation hole and hollow part is applicable as the core rod 110*a*.

Embodiment 15

Next, explanation will be given on still another example of a heating roller with reference to FIGS. 27A-27E.

Figure 27A:
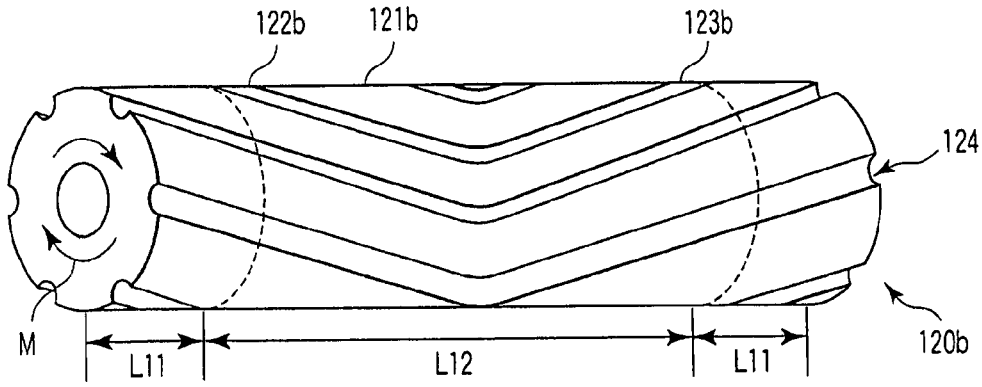
FIGS. 27A-27E are drawing explaining still another examples of the roller applicable to the fixing apparatus shown in FIG. 1.

FIG. 27A is a schematic perspective view of a foamed rubber layer 120*b*.

The foamed rubber layer 120*b* has a center part 121*b* having the length L12, and end parts 122*b* and 123*b* which are located at both ends of the center part 121*b* and have the length L11, and is formed uniformly in the axial direction in the outside diameter D28.

The foamed rubber layer 120*b* has at least one air vent 123 formed like V-shape over the axial direction in the external circumference. In other words, the air vent 124 has lines of notch crossing the axis at a predetermined angle from the center to end in the axial direction, symmetric with respect to the axial direction. Namely, the air vent 124 penetrates the external circumference of the foamed rubber layer 120*b* in the axial direction.

Figure 27B:
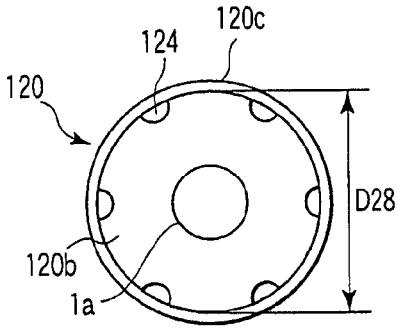

FIG. 27B is a cross section of the heating roller 120 including the foamed rubber layer 120*b*.

The heating roller 120 consists of a metal conductive layer 120*c* having the uniform inside diameter D28, a foamed rubber layer 120*b* provided inside the metal conductive layer 120*c*, and a core rod 1*a* provided inside the foamed rubber layer 120*b*.

The end parts 122*b* and 123*b* contact the metal conductive layer 120*c*, and is bonded in the whole surface or a part of the contacting area by using a heat-resistant adhesive, for example. The center part 121*b* is not contacting the metal conductive layer 120*c*.

When the heating roller 120 is rotated in the state supplied with a predetermined pressure from the pressing roller 2, the heating roller is provided, so that the top of the V-shape of the air vent 124 in the foamed rubber layer 120*c* (connecting the outside to the outside) reaches fastest the position (nip) contacting the pressing roller 2. Namely, the foamed rubber layer 120*b* is provided so as to rotate in the arrow M direction.

Thus, a material to be transferred passes between the heating roller 120 and pressing roller 2, just like being pulled by both ends in the axial direction. This prevents generation of a wrinkle.

The foamed rubber layer 120*c* is symmetric with respect to the center of circle, or the axis in the cross section, and the air vent 124 is preferably provided in even number. This prevents generation of deflected stress when the transferred material passes between the heating roller 120 and pressing roller 2, and the transferred material is moved in the direction vertical to the axis, and this makes it more difficult to generate a wrinkle.

Figure 27C:
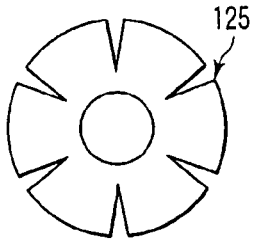

As shown in FIG. 27B, this embodiment may be an air vent 124 that is semicircular and has a predetermined depth in the cross section, or may also be a notch 125 having a predetermined depth, as shown in FIG. 27C. The notch 125 may be a simple notch.

Next, explanation will be given on a modification of the foamed rubber layer 120*b* with reference to FIG. 27D.

Figure 27E:
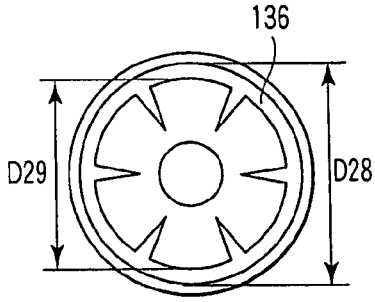
Figure 27D:
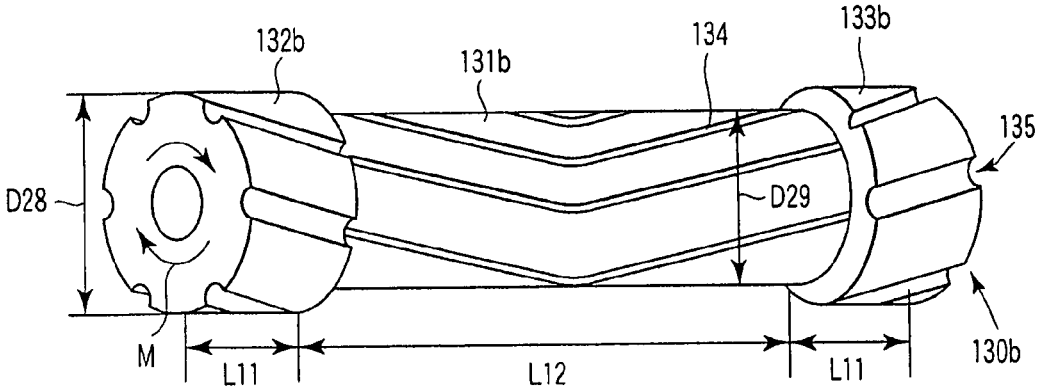

As shown in FIG. 27D, a foamed rubber layer 130*b* has a center part 131*b* having the length L12, and end parts 132*b* and 133*b* which are located at both ends of the center part 131*b* and have the length L11. The end parts 132*b* and 133*b* are formed in the outside diameter D28, and the center part 131*b* is formed in the outside diameter D29 smaller than D28.

In the circumference of the foamed rubber layer 130*b*, air vents 134 and 135 are formed with the top of V-shape positioned in the upstream side of the rotating direction, as in the foamed rubber layer 120*b*. Thus, the air vent 134 formed in the circumference of the center part 131*b* and the air vent 135 formed in the circumference of the end parts 132*b* and 133*b* may not be continued. The air vent 135 can exhaust the air in the center part to the outside, when a metal conductive layer is provided outside the foamed rubber layer 130*b*.

When the inside diameter of a metal conductive layer is D28, a gap 136 is formed in the center part as shown in FIG. 27E. The present invention is not limited to this. A predetermined fitting as shown in FIGS. 20A-20E is also permitted.

The air vents 134 and 135 may be semicircular notch or simple cut, as shown in FIGS. 27B and 27C.

Embodiment 16

Figure 28A:
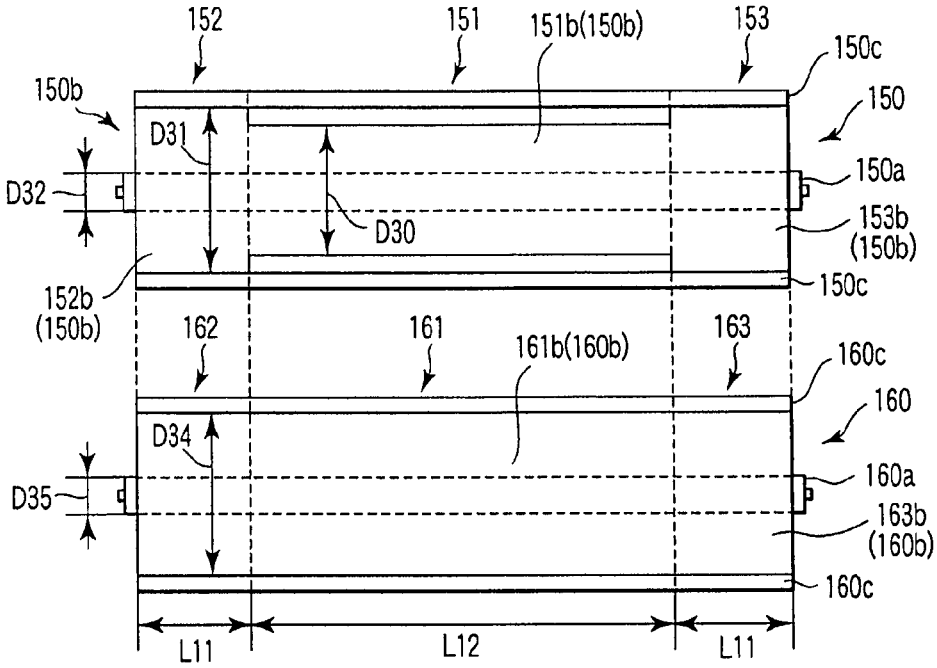
FIGS. 28A-28C are drawing explaining still another examples of the roller applicable to the fixing apparatus shown in FIG. 1.
Figure 28B:
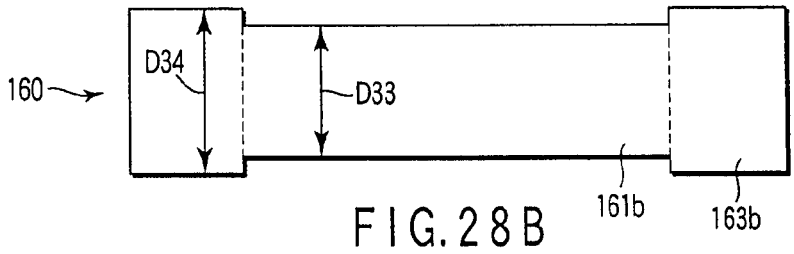
Figure 28C:
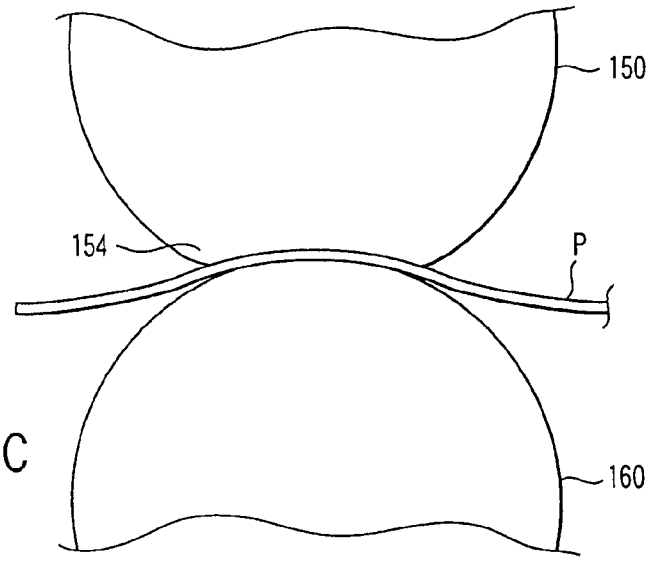

FIGS. 28A-28C show still another examples of the heating roller and pressing roller shown in FIG. 1.

As shown in FIG. 28A, a heating roller 150 consists of a center part 151 having the length L12 in the axial direction, and end parts 152 and 153 which are located at both ends of the center part 151 and have the length L11. The center part 151 has a fifth hardness, and the end parts 152 and 153 have a sixth hardness.

The heating roller 150 includes a core rod 150*a*, a foamed rubber layer 150*b*, and a metal conductive layer 150*c*. The foamed rubber layer 150*b* consists of a center foamed rubber layer 151*b* corresponding to the center part 151, an end foamed rubber layer 152*b* corresponding to the end part 152, and an end formed rubber layer 153*b* corresponding to the end part 153. The center formed rubber layer 151*b* has the outside diameter D30, the end foamed rubber layers 152*b* and 153*b* have the outside diameter D31, and the core rod 150*a* has the outside diameter D32.

The pressing roller 160 consists of a center part 161 having the length L12 in the axial direction, and end parts 162 and 163 which are located at both ends of the center part 161 and have the length L11. The center part 151 has a seventh hardness larger than the fifth hardness, and the end parts 152 and 153 have an eighth hardness larger than the sixth hardness.

The pressing roller 160 includes a core rod 160*a*, a foamed rubber layer 160*b*, and a metal conductive layer 160*c*. The foamed rubber layer 160*b* consists of a center foamed rubber layer 161*b* corresponding to the center part 161, an end foamed rubber layer 162*b* corresponding to the end part 162, and an end foamed rubber layer 163*b* corresponding to the end part 163.

The center formed rubber layer 161*b* has the outside diameter D33, the end foamed rubber layers 162*b* and 163*b* have the outside diameter D34, and the core rod 160*a* has the outside diameter D35.

The heating roller 150 and pressing roller 160 are arranged with their center and end parts faced each other. The pressing roller 160 supplies a predetermined pressure to the heating roller 150. In this time, as the center part 151 of the heating roller 150 is softer (smaller in hardness) than the center part 161 of the pressing roller 160, it changes larger than the pressing roller 160.

As shown in FIG. 28C, the cross section of the nips of the heating roller 150 and pressing roller 160 viewed from the axial direction, the nip of the pressing roller 160 bits the heating roller 150, and the nip of the heating roller 150 sinks in the axis side (inside). If the fifth hardness of the center part 151 of the heating roller 150 is small (soft), the curvature of the center part 151 of the heating roller 150 is rapidly changed in the downstream of the paper P conveying direction, as shown in FIG. 28C. Namely, the downstream side 154 of the center part 151 projects to the pressing roller 160. Thus, the contacted and fused toner becomes easy to separate from the surface of the heating roller 150.

Therefore, this embodiment can solve the problem that when the apparatus of this embodiment is used in an image forming apparatus capable of forming a color image using much toner, a paper sheet sticks to a heating roller and becomes hard to separate from the roller because a lot of toner is used.

Next, explanation will be given on examples of a heating roller 150 having fifth and sixth hardness and a pressing roller 160 having seventh and eighth hardness.

The heating roller 150 is formed in the size equivalent to the sample 2 explained in the embodiment 10, and the pressing roller 160 is formed in the size equivalent too the sample 1. Namely, the outside diameters of metal conductive layers 150*c* and 160*c* are 45.0 mm, the outside diameters D32 and D35 of core rods 150*a* and 160*a* are 30.0 mm, the outside diameter D30 of a center foamed rubber layer 151*b* of the heating roller is 43.4 mm, the outside diameter D31 of end foamed rubber layers 152*b* and 153*b* is 45.0 mm, the outside diameter D33 of a center foamed rubber layer 161*b* of the pressing roller is 45.0 mm, and the outside diameter D34 of end foamed rubber layers 162*b* and 163*b* are 46.0 mm. The pressing roller 160 may be any one of the samples 3 and 4. Namely, the roller can be formed in the size capable of realizing a predetermined hardness, as explained in the embodiment 10.

Thus, the fifth hardness is E58, the sixth and seventh hardness are E63, the eight hardness is E66, and the inequalities of the fifth hardness<seventh hardness and the sixth hardness<eighth hardness are established.

In this embodiment, any configuration is permitted if at least one of the inequality, the fifth hardness<seventh hardness and the sixth hardness<eighth hardness is established. Namely, any one of the configurations explained hereinbefore will be permitted: the configuration in which the hardness is changed by using the center and end foamed rubber layers having different outside diameters as shown in FIG. 20A-20E, the configuration in which the hardness of the foamed rubber layer is changed as shown in FIGS. 4 and 5, or the configuration in which the roller having the configuration to change the hardness of the metal conductive layer is used as at least one of the heating roller and pressing roller as shown in FIG. 17.

Embodiment 17

Figure 29A:
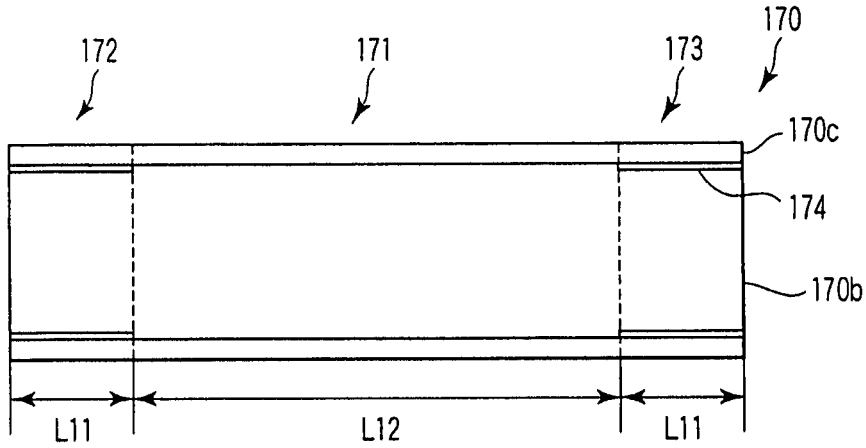
FIGS. 29A-29C are drawing explaining still another examples of the roller applicable to the fixing apparatus shown in FIG. 1.
Figure 29B:
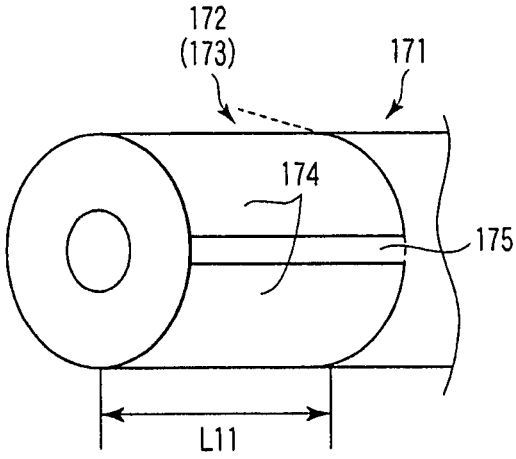
Figure 29C:
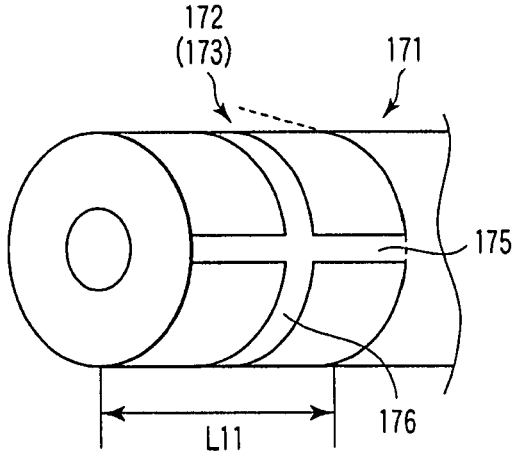

FIGS. 29A-29C show still another example of the heating roller shown in FIG. 1.

As shown in FIG. 29A, a heating roller 170 consists of a center part 171 having the length L12 in the axial direction, and end parts 172 and 173 which are located at both ends of the center part 171 and have the length L11. The heating roller 170 includes a metal conductive layer 170*c* having the uniform inside diameter, and a foamed rubber layer 170*b* having the uniform outside diameter a little smaller than or equivalent to the inside diameter of the metal conductive layer 170*c*, in the axial direction. They both are connected in the end parts 172 and 173 an adhesive.

As shown in FIG. 29B, the end parts 172 and 173 have a bonded part 174 to be applied with an adhesive, and an axial non-bonded part 175 to connect the center part 171 to the outside. Thus, the air in the center part 171 heated by the temperature increase in the heating roller is exhausted to the outside through the non-bonded part 175. This prevents the center part 171 from being hardened by expansion of air.

As shown in FIG. 29C, the end parts 172 and 173 may have another non-bonded part 176 to pass the bonded part 174 in the circumferential direction. This makes it smooth to exhaust the air from the center part 171.

As explained above, the fixing apparatus of the present invention prevents changes in the hardness of the heating roller in the length direction, and prevents consumption and break of the foamed rubber layer 1*b* supporting the metal conductive layer 1*c*, or a thin film, thereby ensuring the nip width larger than a certain value and providing a good image.

Further, the fixing apparatus eliminates changes in the hardness of a roller caused by expansion of the air in a foamed rubber by changing the heating temperature, thereby eliminating fluctuation in the nip width.

Moreover, by using a foamed rubber layer or metal conductive layer having the different diameters in the axial direction, or a heating roller having the both layers, a material to be transferred passing through the pressing roller is convened just like pulled toward the both ends in the axial direction, preventing a wrinkle.

Embodiment 18

Figure 30:
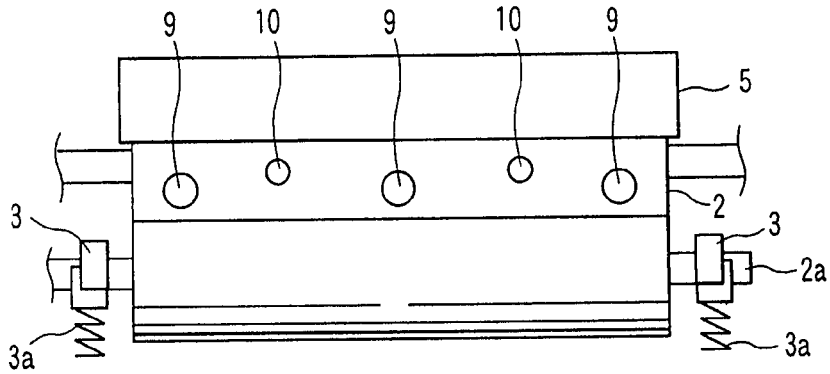
FIG. 30 is a schematic diagram showing the fixing apparatus shown in FIG. 1, in the state viewed from the front side (paper loading side) of the direction of conveying a paper sheet.

FIG. 30 shows a fixing apparatus in the state viewed from the front side (paper loading side) of the direction of conveying a paper sheet. Three thermistors 9 and two thermostats 10 are provided in the length direction of the heating roller 1.

Figure 31:
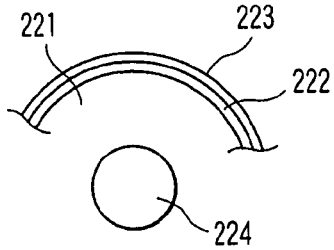
FIG. 31 is a schematic diagram explaining the features of the configuration applicable to the endless material used in the fixing apparatus shown in FIG. 1 and FIG. 30.

FIG. 31 is a schematic diagram explaining the features of the configuration applicable to the heating roller or pressing roller, or an endless material used in the fixing apparatus explained with reference to FIG. 1 and FIG. 30. The features (configuration) explained hereinafter are applicable to at least one of the heating roller and pressing roller. Of course, the same structure is applied to both rollers.

As shown in FIG. 31, the endless material has a cylindrical or belt-like elastic material 221. The elastic material 221 is made of a heat-resistant foamed material, for example, and has heat insulation of 0.25 W/m×k or lower in heat conductivity. The elastic material 221 is elastic with hardness (ASCAR-C rubber hardness) of 45 degree or lower, and made of a material with a modulus of elasticity (Young's modulus) of 3.5×10-4 or lower. Of course, a heat-resisting temperature is higher than a fixing temperature required in a fixing apparatus.

The elastic material 221 is provided with a mold release layer 223 which can suppress adhesion of a conductive layer 222 having a predetermined heat capacity, toner or dust of a paper sheet P to the side contacting the paper sheet P when being incorporated in the fixing apparatus shown in FIG. 1 and FIG. 30.

The conductive layer 222 is a film or sheet-like metal layer (thin metal layer) with a predetermined thickness, in which a film or sheet-like metal is fixed to the elastic material 221 by welding or deposition different from bonding with an adhesive. The conductive layer 222 can also be formed by precipitation, plating or electric casting.

The mold release layer 223 is a thin film formed by stacking heat-resistant silicon rubber, for example, to a predetermined thickness, and has a high modulus of elasticity. The mold release layer 223 may be a PFA tube or PFA layer. The mold release layer 223 is omissible, when a paper sheet P fixed with toner in a nip part 4 can be securely separated from a heating roller.

The endless member is formed cylindrical or belt-like optional endless shape, so that its side 224 to the elastic material 221 is located inside. Thus, the endless member is applicable to one of or both the heating roller 1 and pressing roller 2. When the endless member is formed cylindrical, the inside is not necessarily hollow.

In the fixing apparatus explained above, as the hardness (ASCAR-C rubber hardness) of the endless member 221 is lower than 45 degree, when it is used in a fixing apparatus with a low image forming speed, the toner on a paper sheet, especially a character image is prevented from being collapsed by receiving an excessive pressure, as the time to pass through a nip becomes long. Further, when the toner on a paper sheet is a color image and a plurality of toners is overlaid, it is prevented that the degree of luster goes out of a predetermined degree (range) because of the excessive hardness of the roller.

Further, as the modulus of elasticity of the endless member 21 is set to 3.5×10-4 or lower, the elastic force is strong when the deformed nip 4 is restored to the original shape, preventing the toner on the paper sheet from being pulled to cause a displaced image when the paper is separated.

The conductive layer 222 is formed by fixing a film of predetermined thickness or sheet-like metal layer (thin metal layer) to the elastic material 221 by welding or deposition. Thus, even when it is used as a fixing apparatus for a long time at a temperature capable of fixing toner to a paper sheet P, about 200° C. for example, there is no bad influence such as a wrinkle caused by peeling off of the conductive layer 222. This prevents a blur or displacement in the toner fixed to a paper sheet P passing through the nip 4, or an image fixed to a paper sheet P.

Embodiment 19

Figure 32:
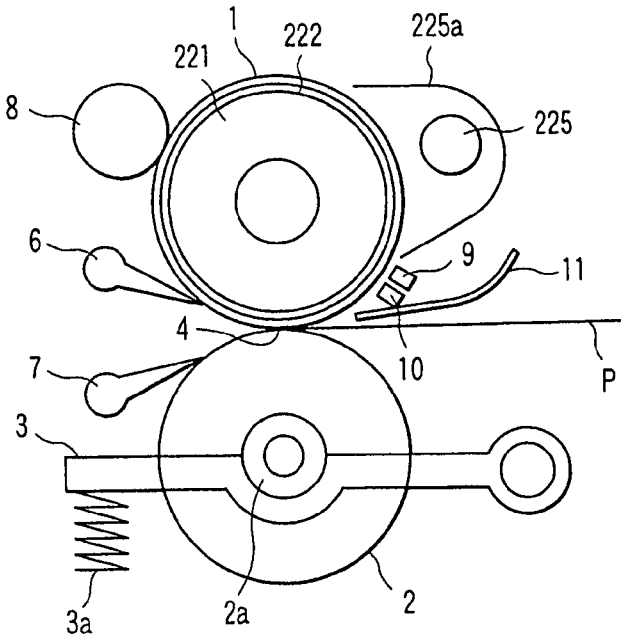
FIG. 32 is a schematic drawing showing a modification of the fixing apparatus shown in FIG. 1 and FIG. 30.

FIG. 32 is a schematic diagram showing a modification of the fixing apparatus explained with reference to FIG. 1 and FIG. 30. The same reference numerals are given to the same components as those of the fixing apparatus explained with reference to FIG. 1 and FIG. 30, and detailed description will be omitted.

In the fixing apparatus shown in FIG. 32, the heating roller 1 made of the endless material formed cylindrical with its side 224 to the elastic material 221 located inside is heated by a heater lamp 225 which can radiate relatively much heat rays, for example, infrared rays or far infrared rays, and by a reflector 225*a* which reflects the heat radiated from the heater lamp 225 toward the conductive layer 222 of the heating roller 1. As the heater lamp 225, for example, a well-known halogen lamp or the like is easily available at a low price.

Further, in the fixing apparatus shown in FIG. 32, the inside of the heating roller 1 is not necessarily be hollow (may be solid).

Therefore, in the fixing apparatus explained with reference to FIG. 32, all effects provided by the fixing apparatus explained with reference to FIG. 1 and FIG. 30 can be obtained. As to the cost, the fixing apparatus of FIG. 32 is not inferior to the fixing apparatus of FIG. 1 and FIG. 30.

Embodiment 20

Figure 33:
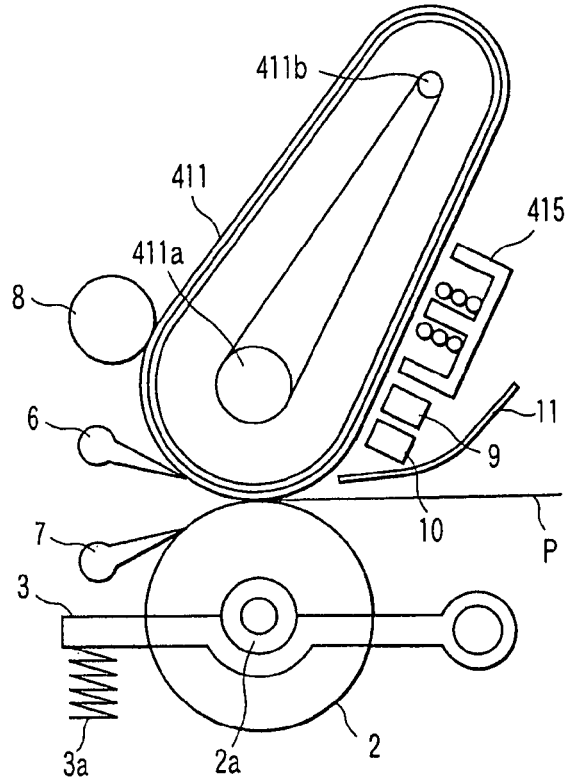
FIG. 33 is a schematic diagram showing an example of the fixing apparatus shown in FIG. 1 and FIG. 30, in which a heating roller is made like a belt.

FIG. 33 is a schematic diagram of an example of the fixing apparatus explained with reference to FIG. 1 and FIG. 30, in which the heating roller is formed like a belt. The same reference numerals are given to the same components as those of the fixing apparatus explained with reference to FIG. 1 and FIG. 30, and detailed description will be omitted.

The fixing apparatus shown in FIG. 33 is characterized by using a heating belt 411, which is made of an endless member with a predetermined circumference length, and hung over axes 411*a* and 411*b* as a belt (loop). The thickness of the elastic material (corresponds to the reference numeral 221 in FIG. 31) of the heating belt 411 is about 7 mm, for example. A heating unit 415 employs an induction heating method in the example shown in FIG. 33.

In the fixing apparatus shown in FIG. 33, all effects provided by the fixing apparatus explained with reference to FIG. 1 and FIG. 30 can be obtained. As to the cost, the fixing apparatus of FIG. 33 is not inferior to the fixing apparatus of FIG. 1 and FIG. 30.

In the fixing apparatus explained with reference to FIG. 1 and FIG. 30, the endless member of the heating roller 1 is formed cylindrical, so that the side 224 to the elastic material 221 explained with reference to FIG. 31 is located inside. Thus, considering the heating roller 1 itself, it is predicted that the elastic material 221 is deteriorated by the influence of pressure and heat, as the number of image forming is increased.

Embodiment 21

As explained hereinafter with reference to FIG. 34, even if the elastic material of a heating roller is deteriorated and the modulus of elasticity is increased, it is preferable to provide a flange 512 in a roller part 511 (an area contacting a paper sheet P when a paper sheet P is conveyed) which contributes the fixing.

By decreasing the elasticity (increasing the hardness) of the parts other than the area (roller part) 511 used for fixing toner to a paper sheet, with respect to the length direction of a heating roller, the roller part 511 is prevented from being applied with a pressure larger than a predetermined value, regardless of the number of image forming.

With this structure, the nip width defined between the pressing roller is maintained constant for a long period, and if the number of image forming is increased, a fixed image is prevented from being collapsed caused by the increased nip width, for example. It is also prevented that a paper sheet winds around a heating roller or a pressing roller without being peeled off.

The flange 512 is made of non-conductive metal or material other than metal with small heat capacity, for example. In this case, a manufacturing method and process are not restricted. As a configuration or a method for fixing (connecting) the flange 512 and endless member, or the elastic material 221, various well-known methods such as bonding can be used. In this case, it is preferable to fix the flange 512 and heating roller 511 (elastic material) in the state that the end part of the elastic material (roller body) is contacting the flange 512 in the whole surface.

Further, as the flange 512 is made of non-conductive metal or material other than metal, when it is heated by a heating unit, it is prevented that the temperature of the end part passing no paper sheets is increased undesirably.

As the roller body 511 and flange 512 are made of different material, the heat volume generated in the roller body 511 transmitted to the axis 513 of the flange 512 is decreased. Therefore, the temperature increase in a not-shown bearing is prevented, and the cost of the bearing is decreased.

Embodiment 22

Figure 35:
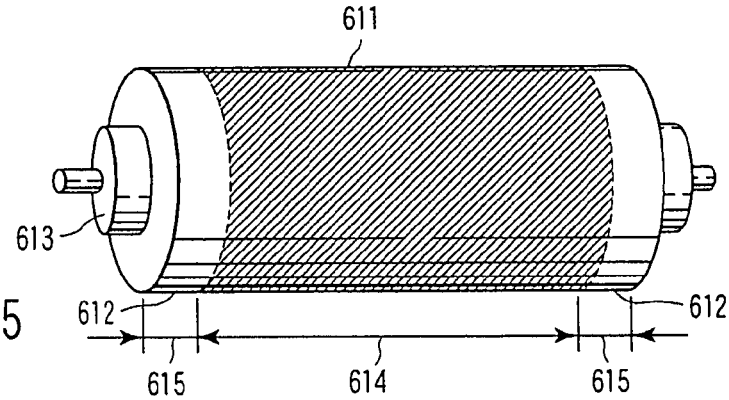
FIG. 35 is a schematic diagram explaining the features of the configuration of the heating roller applicable to the fixing apparatus shown in FIG. 1, FIG. 30 and FIG. 32.

FIG. 35 explains another embodiment which can suppress deterioration of an endless member or elastic material caused by the influence of pressure and heat.

A heating roller shown in FIG. 35 is characterized by decreasing the elasticity (increasing the hardness) of the parts other than the area (roller part) 611 used for fixing toner to a paper sheet, or the roller end 612, with respect to the length direction of a heating roller.

Namely, even if the elastic material of a heating roller is deteriorated and the modulus of elasticity is increased, a roller part 611 is made of elastic material with the hardness of an end part 612 increased to prevent application of pressure larger than a predetermined value to the roller part contributing to the fixing (an area contacting a paper sheet P when a paper sheet P is conveyed), and the roller part 611 is prevented from being applied with a pressure larger than a predetermined value, regardless of the number of image forming.

In this case, the hardness of elastic material corresponding to the roller part 611 and both ends 612 can be easily set by controlling the foaming rate of the elastic material, for example.

By defining the length of the roller part 611 in the axial direction to be a little longer than the area contacting a paper sheet P at least when a paper sheet P is conveyed, the apparatus can be manufactured with the relatively loose lower limit of the manufacturing control width 614, that is, with a low cost. As the length of the area 615 corresponding to both ends 612 in the axial direction can be optionally set to the length giving no influence to the fixing performance when fixing toner to a paper sheet, the apparatus can be easily formed only by controlling the manufacturing process not to reduce the control width 614 of the roller part 611 to shorter than the lower limit value.

Further, the length of the control width 614 of the roller part 611 is set to a little wider (longer) than the width of a paper sheet with the maximum width, and when conveying an A4 size paper sheet in the state that the shorter side is faced to the direction orthogonal to the conveying direction, for example, the length is set to wider (longer) than 297 mm.

Embodiment 23

Figure 38:
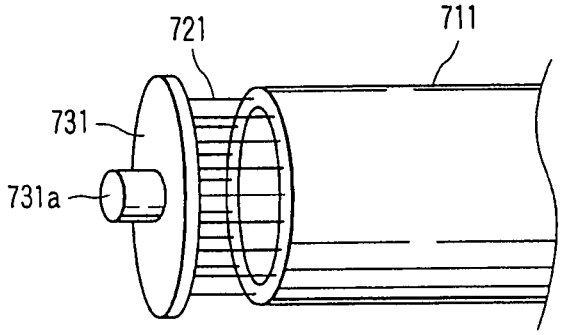
FIG. 38 is a schematic diagram explaining the features of the configuration of the heating roller applicable to the fixing apparatus shown in FIG. 1, FIG. 30 and FIG. 32.

FIG. 38 is a schematic diagram explaining another embodiment of the configuration of the flange of an endless member, or a heating roller.

Figure 34:
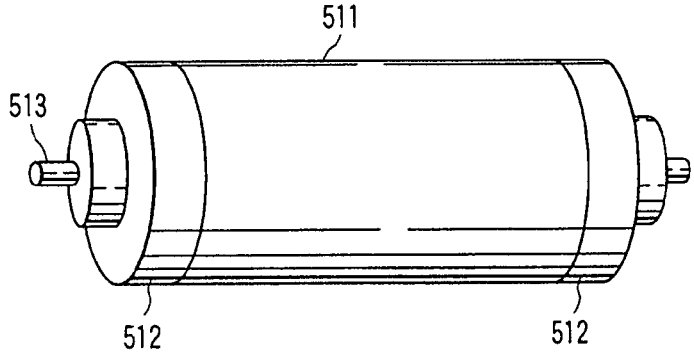
FIG. 34 is a schematic diagram explaining the features of the configuration of the heating roller applicable to the fixing apparatus shown in FIG. 1, FIG. 30 and FIG. 32.

As shown in FIG. 38, a flange 731 may be connected to both ends of an endless member or a heating roller 711 by using a plurality of wires 721, instead of the flange shown in FIG. 34, for example.

Namely, by decreasing the elasticity (increasing the hardness) of the parts other than the area (roller part) 711 used for fixing toner to a paper sheet, among the elastic materials of a heating roller, the roller part 711 is prevented from being applied with a pressure larger than a predetermined value, regardless of the number of image forming.

With this structure, the nip width defined between the pressing roller is maintained constant for a long period, and if the number of image forming is increased, a fixed image is prevented from being collapsed caused by the increased nip width, for example. It is also prevented that a paper sheet winds around a heating roller or a pressing roller without being peeled off.

As the flange 731 and heating roller 711 are connected by a plurality of wires (connectors) 721 without undesirably lowering the elasticity of the heating roller 711 or restricting deformation of the heating roller, the nip width of the nip 4 can be suitably controlled.

Since the flange 731 and heating roller 711, or the elastic material 221 are manufactured in different processes, the versatility of the heating roller 711 is increased.

Further, as the flange 731 is made of non-conductive metal or materials other than metal independently of the roller body, when it is heated by a heating unit, the end part of the roller body where a paper sheet does not pass is prevented from being undesirably increased in temperature.

As explained with reference to FIG. 34, by providing a rigid axis 731 a opposite to the side contacting the end part of the heating roller 711 of the flange 731, the pressure supplied from the pressing spring 3*a* and pressing mechanism through the pressing roller can be set substantially uniform for all areas of the heating roller 711 in the length direction.

Namely, by providing the axis 731*a*, the pressure in the nip 4 defined in the space to the pressing roller 2 is made uniform, and the fixing performance is improved. Further, in case of color image by color toner, for example, the degree of luster in the direction orthogonal to the length direction of the heating roller, or the paper conveying direction is made uniform.

As a material of the axis 731*a*, metal such as aluminum or stainless steel, or ceramic is suitable. The axis 731*a* may be penetrated through the inside of the heating roller 711, though not shown.

Further, by separating the roller body 711 and flange 731, the axis 731*a* is prevented from being heated by the heat from the roller body 711, suppressing the temperature rise in a not-shown bearing. This decreases the cost of the bearing.

Embodiment 24

Figure 36:
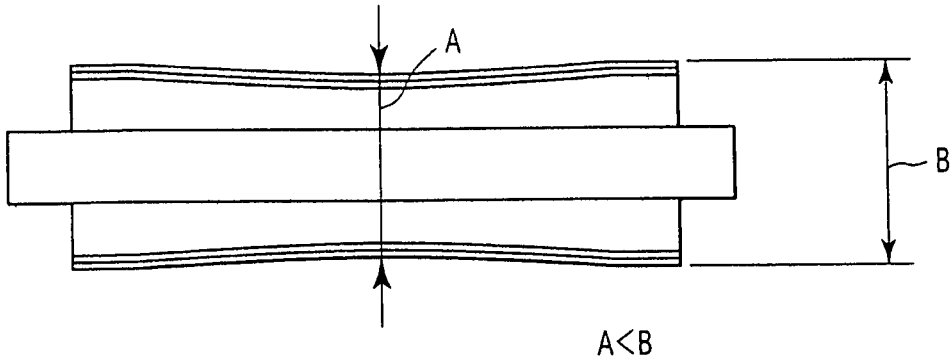
FIG. 36 is a schematic diagram explaining the features of the configuration of the heating roller applicable to the fixing apparatus shown in FIG. 1, FIG. 30 and FIG. 32.
Figure 37:
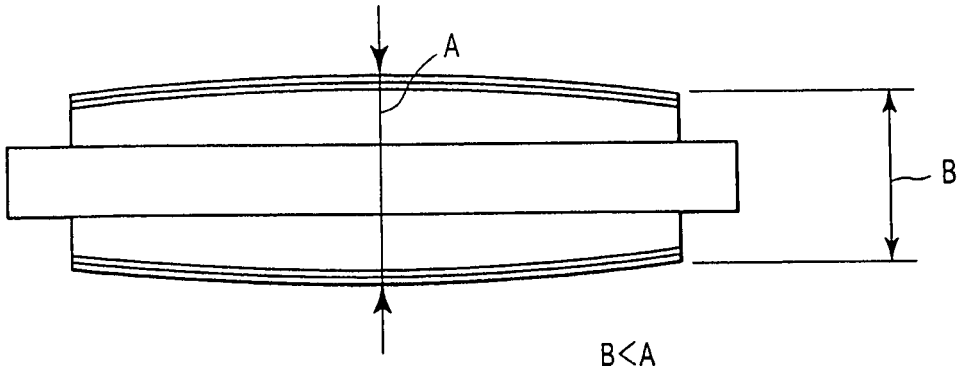
FIG. 37 is a schematic diagram explaining the features of the configuration of the heating roller applicable to the fixing apparatus shown in FIG. 1, FIG. 30 and FIG. 32.

FIG. 36 and FIG. 37 explain the features of the external form when an endless member, or elastic material is formed cylindrical. As explained before, when the elastic material is formed cylindrical, it is applicable to one of or both heating roller and pressing roller. Here, it is called an elastic metal roller.

The elastic metal roller shown in FIG. 36 and FIG. 37 is changed gradually in the outside diameter along the axial direction. The example shown in FIG. 36 is formed to have a larger diameter (outside diameter) in both end parts (part B), compared with a center part (part A) in the axial (length) direction. The example shown in FIG. 37 is formed to have a small diameter (outside diameter) in both end parts (part B), compared with a center part (part A) in the axial (length) direction.

With this structure, a force is applied to the corners of a paper sheet P when the paper sheet is exhausted from the nip 4, and the paper sheet P is prevented from being wrinkled. The paper sheet P is also prevented from being curled caused by changes in the curvature in the paper sheet conveying direction.

It is of course necessary not to select the heating roller and pressing roller with the same features (external form).

As an elastic metal roller, this embodiment is a roller in which the hardness of both end parts of the roller body in the length direction is increased compared with the center part, as explained above with reference to FIG. 34 and FIG. 35. The area where the hardness should be changed has been explained with reference to FIG. 35. It is to be set a little wider (longer) than the maximum width (maximum paper passing width) of the paper sheets to be conveyed. For example, when conveying an A3 size paper sheet with the short side faced to the direction orthogonal to the conveying direction, it is set to 297 mm or wider (longer).

Embodiment 24

Figure 39:
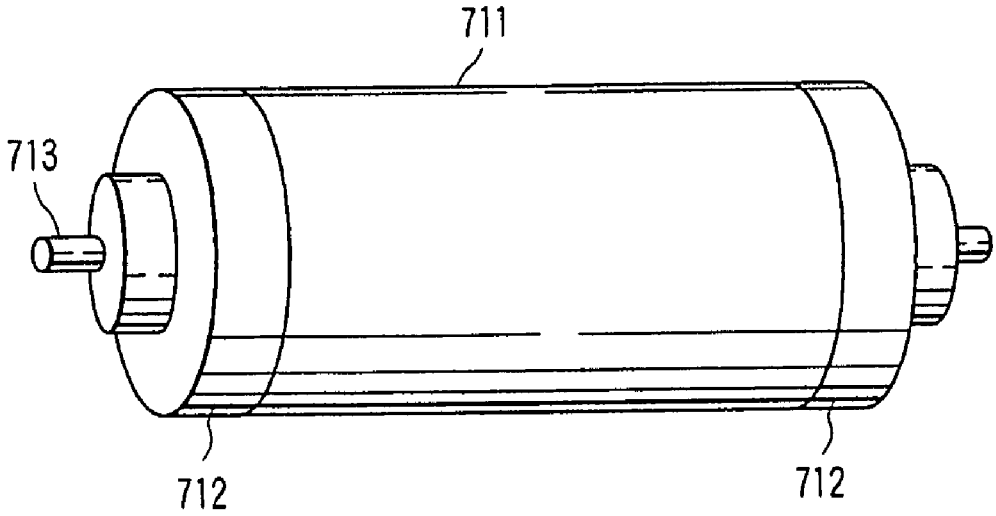
FIG. 39 is a schematic diagram explaining the features of the configuration of the heating roller applicable to the fixing apparatus shown in FIG. 1, FIG. 30 and FIG. 32.

FIG. 39 explains an embodiment in which the pressure of an endless member, or elastic material can be substantially uniform in the length direction of a nip.

In a heating roller shown in FIG. 39, a flange 712 is provided in an area, or a roller part other than that used for fixing toner to a paper sheet 711, and an axis 713 is penetrated through the roller part 711. As a roller body itself, one with higher hardness in both ends than the roller explained above with reference to FIG. 34 and FIG. 35 is used.

By making the axis 713 a through axis, the pressure supplied from a pressing roller can be set to substantially uniform for all areas of the roller body 711 in the length direction. As a material of the axis 713, metal such as aluminum or stainless steel, or ceramic is suitable.

Namely, by providing the axis 713, the pressure in the nip 4 defined in the space to the pressing roller 2 is made uniform, and the fixing performance is improved. Further, in case of color image by color toner, for example, the degree of luster is made uniform.

By configuring the flange 712 with a material with small heat capacity according to the example shown in FIG. 34, it is prevented that the temperature of the end part where a paper sheet does not pass is undesirably increased when heated by a heating unit.

The inside of the roller body (elastic material) is not necessarily hollow, but may of course be hollow.

Embodiment 25

Figure 40:
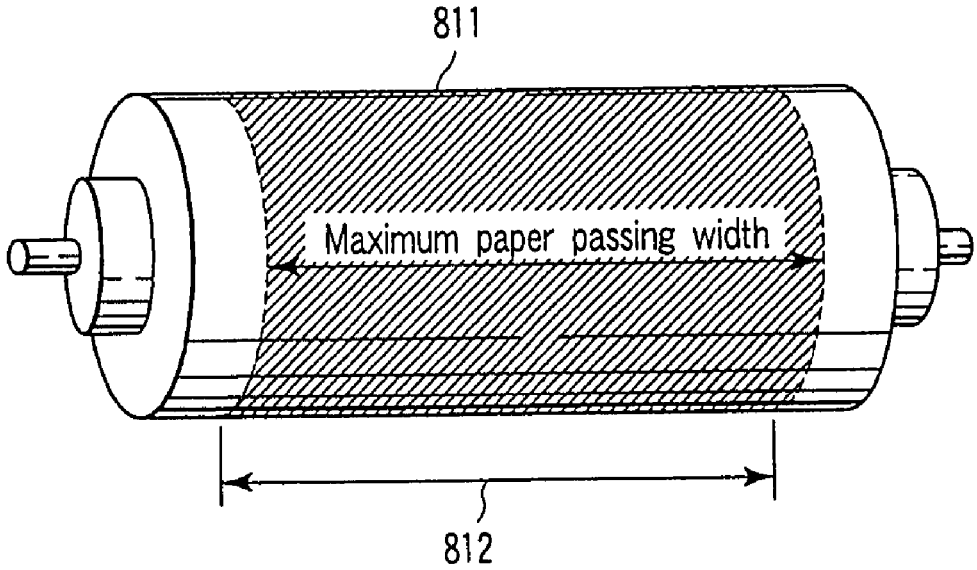
FIG. 40 is a schematic diagram explaining the features of the configuration of the heating roller applicable to the fixing apparatus shown in FIG. 1, FIG. 30 and FIG. 32.

FIG. 40 explains another features of an endless member, or elastic material.

As shown in FIG. 40, the length 812 of a center part of an elastic material 811, or a conductive layer in the area contacting a paper sheet when conveyed (explained by the reference numeral 222 in FIG. 31) is set a little wider (longer) than the maximum width (maximum paper passing width) of the paper sheets to be conveyed, as explained with reference to FIG. 35. For example, when conveying an A3 size paper sheet with the short side faced to the direction orthogonal to the conveying direction, it is set to 297 mm or wider (longer).

Namely, the range of the conductive layer n the axial direction is expressed by

Maximum paper passing width<Conductive layer range<Elastic material length

By setting the length of the area where the conductive layer of a roller body 811 is formed based on the maximum width of a paper sheet to be conveyed, when it is heated by a heating unit, the end part where a paper sheet does not pass is prevented from being undesirably increased in temperature.

As explained above, the fixing apparatus of the present invention provides stable fixing performance for a long period by using an elastic material provided with at least conductive layer in the surface contacting a fixing object. By making both ends of the elastic material like a flange, or by increasing the hardness, the elastic material is suppressed from being deteriorated.

By using an elastic material, a nip can be set suitably, and the nip width and the characteristic of elastic material are prevented from changing as the number of image forming increases, and a defective image forming caused by displaced image (toner) on fixing can be prevented. Further, the pressing performance is improved, and uniform fixing performance can be obtained in al areas in the length direction. When a fixing object is a color image, changes in the degree of luster can also be suppressed.

Since the heat capacity of the conductive layer (heating member) is small, the warm-up time is very short, and power consumption is small as a fixing apparatus.

By forming the conductive layer excluding both end parts of elastic material, or by providing a flange of different member, a temperature increase in a roller bearing mount is suppressed, and the cost of the bearing member is reduced.

Further, by suppressing a temperature increase in both end parts of a roller, and by forming the conductive layer excluding both ends of the roller, even if image forming is repeated for a paper sheet with a narrow width, abnormal temperature rise in the roller ends or paper non-passing part can be prevented.

The present invention is not limited to the above-mentioned embodiments. Various modifications and alternations are possible in embodiments without departing from the essential characteristics. Embodiments can be combined appropriately as far as possible. In that case, the effects by combination can be obtained. For example, an example of a fixing apparatus applicable to a color image forming apparatus has been described to explain the above-mentioned embodiments, but it is of course possible to use in a facsimile or the like using toner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a roller member which includes a core member extending in an axial direction of the roller member, and having a center part in the axial direction and axial end parts located on both sides of the center part, the center part of the core member having a first outside diameter and an axial length, and the axial end parts of the core member having a second outside diameter larger than the first outside diameter and an air vent passing through the axial end part in the axial direction, a support member located outside the core member, and a metal member located outside the support member and formed as a hollow cylinder, the center part of the roller member having a first hardness, and both axial end parts of the roller member having a second hardness which is larger than the first hardness, the second hardness being larger than the first hardness by E1 in measurement with an E-type durometer.

2. The fixing apparatus according to claim 1, wherein the support member includes a center support member located at the center in the axial direction, and end support members located at both ends holding the center support member; and the hardness of each of the end support member is larger than the hardness of the center support member.

3. The fixing apparatus according to claim 1, wherein the core member penetrates the support member.

4. The fixing apparatus according to claim 1, wherein the metal member includes a member to be heated which is elastic material with heat insulation constructed in one body with a conductive layer, and formed cylindrical or an endless belt, the conductive layer is maintained at a predetermined temperature; and a pressing member which supplies a predetermined pressure to the member to be heated.

5. The fixing apparatus according to claim 1, wherein the central part of the core member has an axial length a little larger than the shorter side of A3 size paper sheet.

6. The fixing apparatus according to claim 1, wherein the support member is formed of a cylindrical rubber layer, the central part of the support member is fitted on the central part of the core member and the axial end parts of the support member are fitted on the axial end parts of the core member.

7. The fixing apparatus according to claim 1, wherein the support member is formed of a cylindrical rubber layer having a certain outside diameter and a certain inside diameter in the axial direction, the center part of the support member is located around the central part of the core member with a gap, and the axial end parts of the support member are fitted on the axial end parts of the core member.

8. The fixing apparatus according to claim 7, wherein the air vent communicates with the gap between the core member and the support member and is configured to guide heat existing in the gap to the outside of the roller member.

9. The fixing apparatus according to claim 8, wherein the gap between the core member and the support member is cylindrical defined around the center part of the core member.

10. The fixing apparatus according to claim 1, wherein a thickness of the support member in a direction perpendicular to the axial direction of the core member is smaller than a distance between the core member and the metal member in the direction perpendicular to the axial direction.

11. The fixing apparatus according to claim 10, wherein the center part of the core member is configured to be spaced apart from the central part of the support member in the direction perpendicular to the axial direction of the core member.

12. The fixing apparatus according to claim 11, wherein the air vent is located between the core member and the support member.

* * * * *